US011137718B2

(12) United States Patent
Saeki et al.

(10) Patent No.: US 11,137,718 B2
(45) Date of Patent: Oct. 5, 2021

(54) IMAGE-FORMING APPARATUS CAPABLE OF MOVING DEVELOPING ROLLER BETWEEN CONTACT POSITION IN CONTACT WITH PHOTOSENSITIVE DRUM AND SEPARATED POSITION AWAY THEREFROM

(71) Applicant: BROTHER KOGYO KABUSHIKI KAISHA, Nagoya (JP)

(72) Inventors: Masahito Saeki, Nagoya (JP); Yusuke Ikegami, Nagoya (JP); Toshiyuki Sano, Iwakura (JP); Shintaro Sakaguchi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 16/925,638

(22) Filed: Jul. 10, 2020

(65) Prior Publication Data

US 2021/0011427 A1 Jan. 14, 2021

(30) Foreign Application Priority Data

Jul. 10, 2019 (JP) ..... JP2019-128305

(51) Int. Cl.
*G03G 21/16* (2006.01)
*G03G 21/18* (2006.01)
*G03G 15/08* (2006.01)

(52) U.S. Cl.
CPC ..... *G03G 21/1857* (2013.01); *G03G 15/0808* (2013.01); *G03G 21/1676* (2013.01)

(58) Field of Classification Search
CPC ..... G03G 21/1676; G03G 21/1633
See application file for complete search history.

(56) References Cited

U.S. PATENT DOCUMENTS

2003/0161656 A1* 8/2003 Miura ..... G03G 15/0194 399/116
2005/0053394 A1* 3/2005 Ishii ..... G03G 21/1821 399/111
2007/0146739 A1 6/2007 Igarashi
(Continued)

FOREIGN PATENT DOCUMENTS

JP 2007-178608 A 7/2007
JP 2014-106393 A 6/2014
(Continued)

*Primary Examiner* — Sevan A Aydin
(74) *Attorney, Agent, or Firm* — Scully, Scott, Murphy & Presser, PC

(57) ABSTRACT

An image-forming apparatus includes: a cover; and a separation mechanism. The separation mechanism includes a cam; a cam follower; and a release member. The release member is configured to move the cam follower from an operating position to a non-operating position in accordance with movement of the cover from a closed position to an open position. In a state where the cam follower is at the operating position, the cam follower is guided by the cam in accordance with rotation of the cam to allow the cam follower to slidably move between a protruding position and a standby position. In a state where the cam follower is at the non-operating position, the cam follower is not guided by the cam to allow the cam follower to be maintained at the standby position independently of the rotation of the cam.

16 Claims, 23 Drawing Sheets

(56) References Cited

U.S. PATENT DOCUMENTS

| | | | | |
|---|---|---|---|---|
| 2011/0052254 | A1* | 3/2011 | Hashimoto | G03G 21/1671 399/110 |
| 2013/0084105 | A1* | 4/2013 | Suzuki | G03G 21/1647 399/228 |
| 2013/0156463 | A1* | 6/2013 | Jung | G03G 15/06 399/110 |
| 2014/0147158 | A1 | 5/2014 | Fujinaka et al. | |
| 2015/0093145 | A1 | 4/2015 | Tomatsu et al. | |
| 2015/0160608 | A1 | 6/2015 | Sawashima | |
| 2020/0301351 | A1* | 9/2020 | Ooka | G03G 21/1633 |

FOREIGN PATENT DOCUMENTS

| | | | |
|---|---|---|---|
| JP | 2015-069095 | A | 4/2015 |
| JP | 2015-114461 | A | 6/2015 |

* cited by examiner

IMAGE-FORMING APPARATUS CAPABLE OF MOVING DEVELOPING ROLLER BETWEEN CONTACT POSITION IN CONTACT WITH PHOTOSENSITIVE DRUM AND SEPARATED POSITION AWAY THEREFROM

CROSS REFERENCE TO RELATED APPLICATION

This application claims priority from Japanese Patent Application No. 2019-128305 filed Jul. 10, 2019. The entire content of the priority application is incorporated herein by reference.

TECHNICAL FIELD

The present disclosure relates to an image-forming apparatus capable of moving a developing roller between a contact position in contact with a photosensitive drum and a separated position away therefrom.

BACKGROUND

There has been known an electro-photographic image-forming apparatus including a drawer to which a developing cartridge is attachable. The drawer is attachable to and detachable from a housing and can be pulled out of the housing. In such a conventional image-forming apparatus, a mechanism for moving the developing roller away from a photosensitive drum at the right time has been known in order to restrain degradation of the developing cartridge.

Japanese Patent Application Publication No. 2015-069095 discloses an image-forming apparatus including a separation mechanism configured to move a developing roller away from a photosensitive drum. The disclosed separation mechanism of developing rollers is provided with a cam linearly movable in a direction in which developing cartridges are arranged. In accordance with the movement of the cam in the direction of the arrangement of the developing cartridges, each of the developing rollers in the developing cartridges is movable to a contact position in contact with a corresponding one of the photosensitive drums and a separated position away therefrom. The disclosed separation mechanism has a configuration to linearly move the cam in a pull-out direction of a drawer. Thus, the apparatus is configured to avoid mechanical interference of the cam with a moving path of the drawer when the drawer is attached to and detached from the housing.

SUMMARY

However, some image-forming apparatuses may require a separation mechanism having a configuration different from the disclosed separation mechanism. In a case where a separation mechanism including a component positioned in an opening of a side wall of a drawer is adopted, the separation mechanism may be mechanically interfered with the drawer when the drawer is attached to and detached from the housing.

In view of the foregoing, it is an object of the disclosure to provide an image-forming apparatus capable of avoiding mechanical interference between a separation mechanism and a drawer.

In order to attain the above and other objects, the disclosure provides an image-forming apparatus including: a housing; a cover; a drawer, a developing cartridge; and a separation mechanism. The housing has a first opening. The cover is movable between a closed position closing the first opening and an open position opening the first opening. The drawer includes: a photosensitive drum; and a side wall. The side wall is configured to support the photosensitive drum. The side wall has a second opening. The developing cartridge is attachable to and detachable from the drawer. The developing cartridge includes a developing roller. The developing roller is movable between a contact position in contact with the photosensitive drum and a separated position away from the photosensitive drum. The separation mechanism is configured to move the developing roller between the contact position and the separated position. The separation mechanism includes: a cam; a cam follower; and a release member. The cam follower is slidably movable along an axis between a standby position and a protruding position protruding toward the developing cartridge. The cam follower is pivotally movable about the axis between an operating position and a non-operating position. The release member is movable in accordance with movement of the cover between the open position and the closed position. The release member is configured to move the cam follower from the operating position to the non-operating position in accordance with movement of the cover from the closed position to the open position. In a state where the cam follower is at the operating position, the cam follower is guided by the cam in accordance with rotation of the cam to allow the cam follower to slidably move between the protruding position and the standby position: in a state where the cam follower is at the protruding position, the cam follower is positioned in the second opening to press the developing cartridge to position the developing roller at the separated position; and in a state where the cam follower is at the standby position, the cam follower is positioned out of the second opening to position the developing roller at the contact position. In a state where the cam follower is at the non-operating position, the cam follower is not guided by the cam to allow the cam follower to be maintained at the standby position independently of the rotation of the can.

According to another aspect, the disclosure provides an image-forming apparatus including: a housing; a cover; a drawer; and a separation mechanism. The housing has a first opening. The cover is movable between a closed position closing the first opening and an open position opening the first opening. The drawer includes a side wall. The side wall has a second opening. The separation mechanism is configured to move a developing roller between a contact position where the developing roller is in contact with a photosensitive drum and a separated position where the developing roller is away from the photosensitive drum. The separation mechanism includes: a cam follower; a cam; and a release member. The cam is configured to move the cam follower between a protruding position in which the cam follower is positioned in the second opening and a standby position in which the cam follower is positioned out of the second opening. The release member is configured to move the cam follower from an operating position to a non-operating position in accordance with movement of the cover from the closed position to the open position. In a state where the cam follower is at the operating position, the cam follower is moved by the cam between the protruding position and the standby position in accordance with rotation of the cam. In a state where the cam follower is at the non-operating position, the cam follower is not moved by the cam and the cam follower is at the standby position independently of the rotation of the cam.

BRIEF DESCRIPTION OF THE DRAWINGS

The particular features and advantages of the embodiment (s) as well as other objects will become apparent from the following description taken in connection with the accompanying drawings, in which:

FIG. 13 is a flowchart illustrating steps in a control process executed by a controller of the image-forming apparatus according to the embodiment, the control process being executed when the image-forming apparatus is turned on;

FIG. 15 is a timing chart for description of operations of developing rollers, a cover sensor, a motor, an YMC clutch, and a separation sensor in the image-forming apparatus according to the embodiment after the image-forming apparatus is turned on;

DETAILED DESCRIPTION

Figure 1:
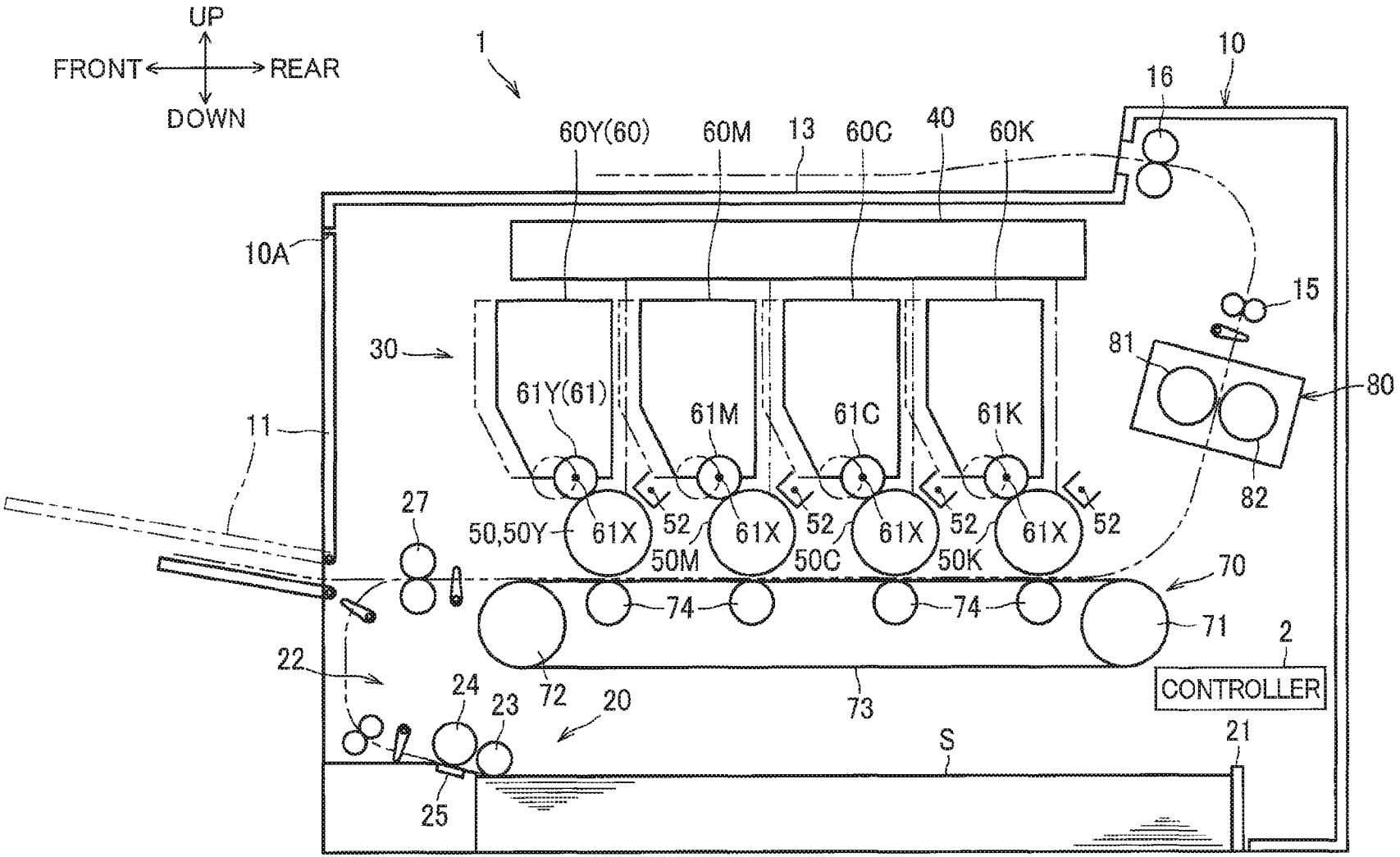
FIG. 1 is a schematic view illustrating an overall configuration of an image-forming apparatus according to an embodiment.

An image-forming apparatus 1 according to one embodiment of the present disclosure will be described with reference to the accompanying drawings. The image-forming apparatus 1 of the present embodiment is a color printer, and includes a housing 10, a cover 11, a sheet feed unit 20, an image-forming unit 30, and a controller 2.

In the following description, a left side, a right side, an upper side, and a lower side in FIG. 1 will be referred to as a front side, a rear side, an upper side, and a lower side of the image-forming apparatus 1, respectively. Further, a near side and a far side in FIG. 1 will be referred to as a right side and a left side, respectively.

The housing 10 has a front end having a first opening 10A. The cover 11 is pivotally movable between a closed position closing the first opening 10A as indicated by a solid line and an open position opening the first opening 10A as indicated by a dashed-two dotted line. The housing 10 is provided with a cover sensor (not illustrated) configured to detect an opening state and a closing state of the cover 11, and the controller 2 is configured to determine the opening state and the closing state of the cover 11 according to a signal transmitted from the cover sensor.

The sheet feed unit 20 is positioned at a lower internal portion of the housing 10. The sheet feed unit 20 includes a sheet tray 21 for accommodating sheets S, and a sheet feed mechanism 22 configured to supply sheets S from the sheet tray 21 toward the image-forming unit 30.

The sheet tray 21 is detachable from the housing 10 by pulling the sheet tray 21 frontward (leftward in FIG. 1).

The sheet feed mechanism 22 is positioned at a front internal portion of the housing 10. The sheet feed mechanism 22 includes a sheet feed roller 23, a separation roller 24, a separation pad 25, and a pair of registration rollers 27. In the present disclosure, the sheet S is an example of an image-forming medium on which an image can be formed by the image-forming apparatus 1. For example, plain paper, an envelope, a post cart, thin paper, heavy paper, glossy paper, a resin sheet, and a seal are available as the sheet S.

In the sheet feed unit 20, the sheets S accommodated in the sheet tray 21 are configured to be fed by the sheet feed roller 23, and then separated one by one by the separation roller 24 and the separation pad 25. Subsequently, a position of the leading edge of each sheet S is configured to be regulated by the registration rollers 27 whose rotation is halted, and the sheet S is then configured to be supplied to the image-forming unit 30 by the rotations of the registration rollers 27.

The image-forming unit 30 includes an exposure device 40, a drawer 90 (FIG. 2) including a plurality of photosensitive drums 50, a plurality of developing cartridges 60, a conveying device 70, and a fixing device 80.

The exposure device 40 includes a laser diode, a deflector, lenses, and mirrors those are not illustrated. The exposure device 40 is configured to emit a plurality of laser beams that expose respective photosensitive drums 50 to scan the surfaces of the photosensitive drums 50.

The photosensitive drums 50 include: a first photosensitive drum 50Y for a color of yellow; a second photosensitive drum 50M for a color of magenta; a third photosensitive drum 50C for a color of cyan; and a fourth photosensitive drum 50K for a color of black. Throughout the specification and drawings, in a case where colors must be specified, members or components corresponding to the colors of yellow, magenta, cyan and black are designated by adding "Y", "M", "C", and "K", respectively. On the other hand, in a case where distinction of colors is unnecessary, the addition of "Y", "M", "C", and "K" is omitted and naming of "first" through "fourth" is also omitted.

Four of the developing cartridges 60 are provided in one-to-one correspondence with the four photosensitive drums 50. Specifically, the developing cartridges 60 include: a first developing cartridge 60Y including a first developing roller 61Y for supplying toner to the first photosensitive drum 50Y; a second developing cartridge 60M including a second developing roller 61M for supplying toner to the second photosensitive drum 50M; a third developing cartridge 60C including a third developing roller 61C for supplying toner to the third photosensitive drum 50C; and a fourth developing cartridge 60K including a fourth developing roller 61K for supplying toner to the fourth photosensitive drum 50K.

The first developing roller 61Y, the second developing roller 61M, the third developing roller 61C, and the fourth developing roller 61K are arranged in line in this order toward downstream in a conveying direction of the sheet S.

Each of the developing cartridges 60 is movable between a contact position where the developing roller 61 is in contact with a corresponding one of the photosensitive drums 50 (indicated by a solid line in FIG. 1) and a separated position where the developing roller 61 is apart from the corresponding one of the photosensitive drums 50 (indicated by a dashed-two dotted line in FIG. 1).

Figure 2:
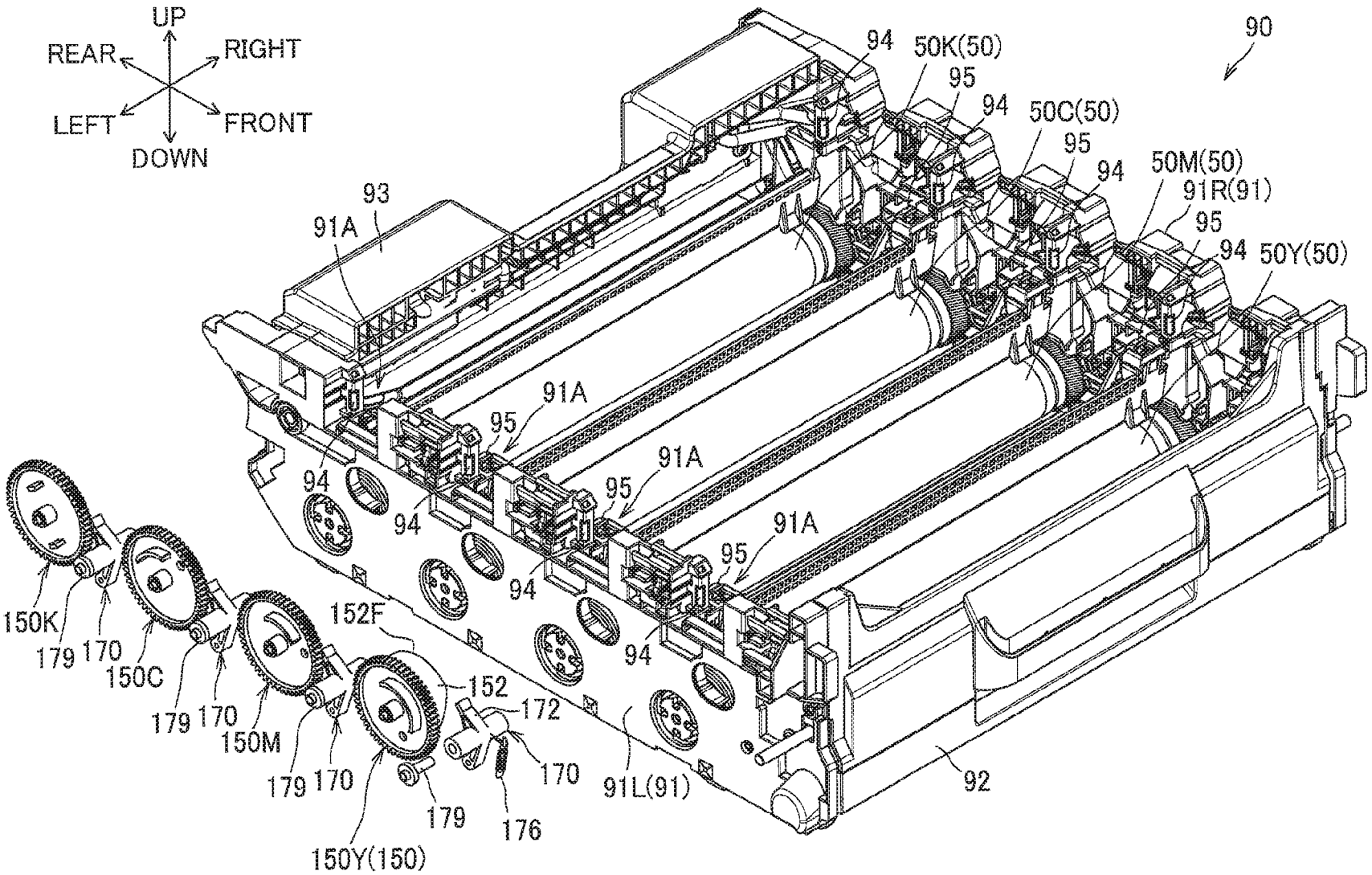
FIG. 2 is a perspective view of a drawer, cams, and cam followers in the image-forming apparatus according to the embodiment.

As illustrated in FIG. 2, the photosensitive drums 50 are rotatably supported by the drawer 90. Further, the drawer 90 detachably supports the first developing cartridge 60Y, the second developing cartridge 60M, the third developing cartridge 60C, and the fourth developing cartridge 60K. The drawer 90 is attachable to and detachable from the housing 10 through the first opening 10A when the cover 11 is opened (FIG. 1).

The drawer 90 includes: a pair of side frames 91 positioned away from each other in an axial direction of each of the photosensitive drums 50; a front connection frame 92 connecting front end portions of respective side frames 91 to each other; and a rear connection frame 93 connecting rear end portions of respective side frames 91 to each other. The pair of side frames 91 includes a right side frame 91R positioned at the right side and a left side frame 91L positioned at the left side.

Further, chargers 52 (FIG. 1) are provided in the drawer 90. Each of the chargers 52 is positioned in face a corresponding one of the photosensitive drum 50 for charging the same.

Although detailed illustration of the structure is omitted, the right and left side frames 91 respectively support right and left end portions of each of the photosensitive drums 50. Further, one of the side frames 91, i.e., the left side frame 91L has four second openings 91A. Each of the second openings 91A is in a form of a recess recessed downward from an upper end of the left side frame 91L. Each of the second openings 91A extends throughout a thickness of the left side frame 91L in a leftward/rightward direction. Thus, each of the second openings 91A is configured to allow a corresponding one of cam followers 170 (described later) to be positioned therein.

The image-forming apparatus 1 further includes four separation mechanisms. Each of the separation mechanisms is configured to move a corresponding one of the first developing roller 61Y, the second developing roller 61M, the third developing roller 61C, and the fourth developing roller 61K between a contact position in contact with a corresponding one of the photosensitive drums 50 and a separated position away from the corresponding one of the photosensitive drums 50. Each of the separation mechanisms is provided for a corresponding one of a first color, a second color, a third color, and a fourth color (yellow, magenta, cyan, and black).

Figure 7:
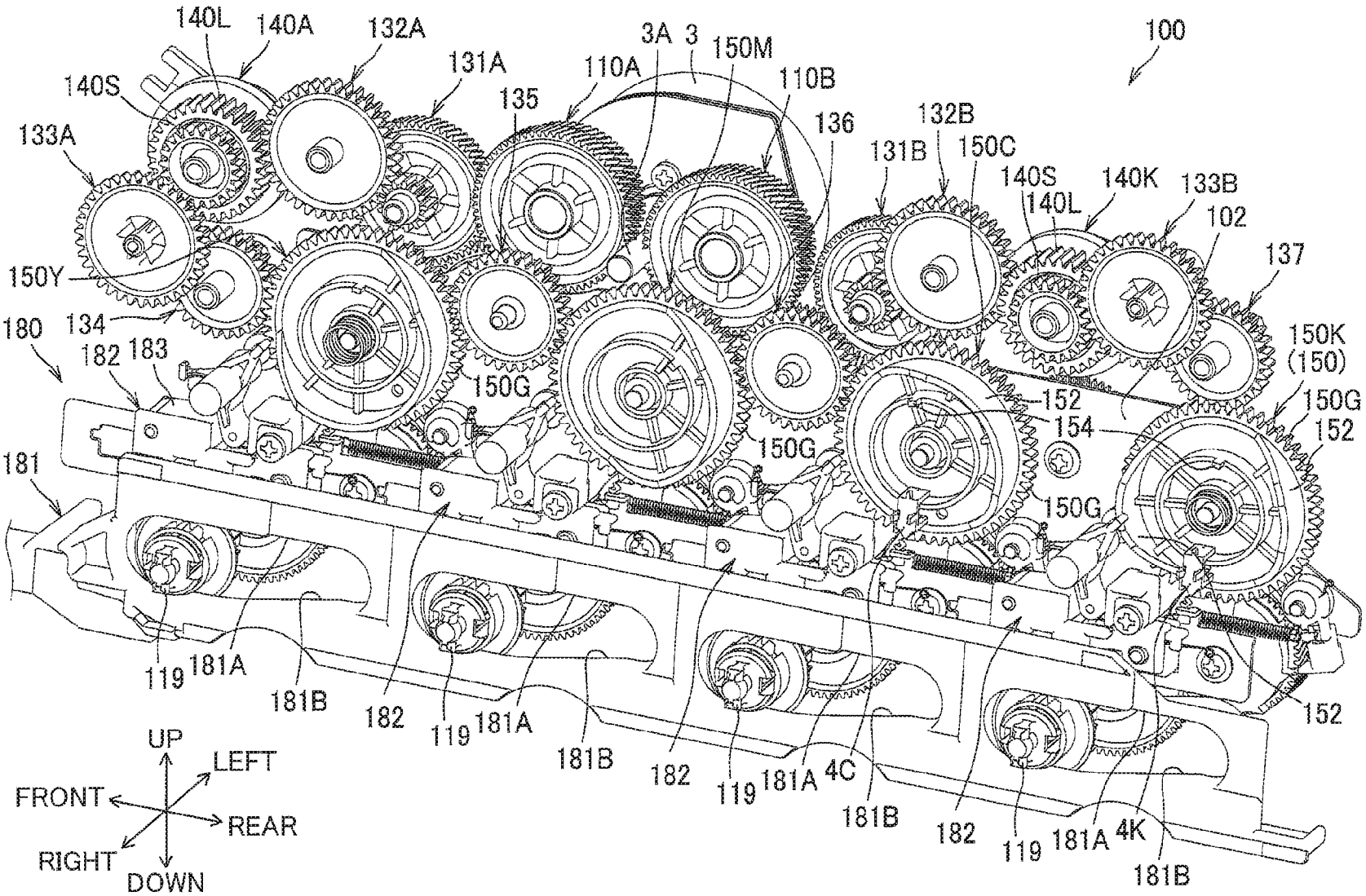
FIG. 7 is a perspective view of the power transmission mechanism as viewed from upper right side thereof.

Specifically, each of the separation mechanisms includes: a cam 150 (150Y, 150M, 150C, 150K) rotatable about an axis parallel to a rotation axis 61X (FIG. 1) of a corresponding one of the developing rollers 60; a support shaft 179; a cam follower 170; a first spring 176; and a release member 180 (FIG. 7).

The cam 150 includes a first cam portion 152 protruding rightward, i.e., inward in a direction of the rotation axis 61X of the corresponding one of the developing rollers 60 (hereinafter simply referred to as "axial direction"). The first cam portion 152A has an end face (right end face) serving as a portion of a cam surface 152F.

The support shaft 179 is elongated in the leftward/rightward direction. The support shaft 179 is provided at a side frame (not illustrated) of the housing 10.

The cam follower 170 is supported by the support shaft 179. The cam follower 170 is slidably movable relative to the support shaft 179 in an axial direction thereof, and is rotatable about an axis of the support shaft 179. The cam follower 170 includes a contact portion 172 contactable with the first cam portion 152.

Specifically, the cam follower 170 is movable between an operating position (illustrated in FIGS. 17A and 17B) where the contact portion 172 is capable of contacting the end face of the first cam portion 152 and a non-operating position (illustrated in FIGS. 18A and 18B) where the contact portion 172 is incapable of contacting the end face of the first cam portion 152. The cam follower 170 is not overlapped with the first cam portion 152 as viewed in the axial direction in a state where the cam follower 170 is positioned at the non-operating position.

Further, in a state where the cam follower 170 is at the operating position, the cam follower 170 is in contact with the cam surface 152F of the first cam portion 152 of the cam 150. Therefore, in the state where the cam follower 170 is at the operating position, the cam follower 170 may be guided by the cam 150 in accordance with the rotation of the cam 150 so as to be slidably movable along the support shaft 179 between a protruding position (illustrated in FIG. 4B) positioning the developing roller 61 at the separated position and a standby position (illustrated in FIG. 4A) positioning the developing roller 61 at the contact position.

In a state where the cam follower 170 is at the protruding position, the cam follower 170 is positioned in the second opening 91A to press the developing cartridge 60, so that the developing roller 61 is positioned at its separated position. In a state where the cam follower 170 is at the standby position, the cam follower 170 is positioned out of the second opening 91A, so that the developing roller 61 is positioned at its contact position.

The non-operating position of the cam follower 170 is provided by the movement of the release lever 180 in accordance with the movement of the cover 11 from the open position to the closed position. In a state where the cam follower 170 is at the non-operating position, the contact portion 172 is not guided by the first cam portion 152, so that the cam follower 170 is maintained at the standby position independently of the rotation of the cam 150.

Turning back to FIG. 2, the image-forming apparatus 1 is provided four pairs of cams 150 and cam followers 170, and each pair of cam 150 and cam follower 170 is provided for a corresponding one of four developing cartridges 60. Each pair of cam 150 and cam follower 170 is positioned leftward of the left side frame 91L, i.e., outward of the left side frame 91L in the leftward/rightward direction. The cams 150, the cam followers 170, and the release members 180 will be described in detail later.

Counterpart abutment portions 94 are provided four each on respective upper portions of the side frames 91R and 91L of the drawer 90. The counterpart abutment portions 94 are configured to abut slide members 64 (FIG. 3A) described later. Each of the counterpart abutment portions 94 is in a form of a roller rotatable about an axis extending in an upward/downward direction. Here, the upward/downward direction may be defined as a third direction which is perpendicular to a first direction (leftward/rightward direction) in parallel to the axial direction of each of the photosensitive drums 50 and a second direction (frontward/rearward direction) in which the photosensitive drums 50 are juxtaposed.

The drawer 90 also includes a plurality of pressure members 95 two each for a corresponding one of the developing cartridges 60. For each of the developing cartridges 60, two of the pressure members 95 are positioned one each outward of a corresponding one of the photosensitive drums 50 in the axial direction thereof. Each of the pressure members 95 is urged rearward by a spring 95A (FIGS. 4A and 4B). In accordance with the attachment of the developing cartridge 60 to the drawer 90, the pair of pressure members 95 presses against the corresponding developing cartridge 60 (specifically, protrusions 63D of the developing cartridge 60 (FIGS. 3A through 4B) as will be described later) by urging forces of the respective springs 95, to permit the developing roller 61 to be in pressure contact with the corresponding photosensitive drum 50.

Figure 3A:
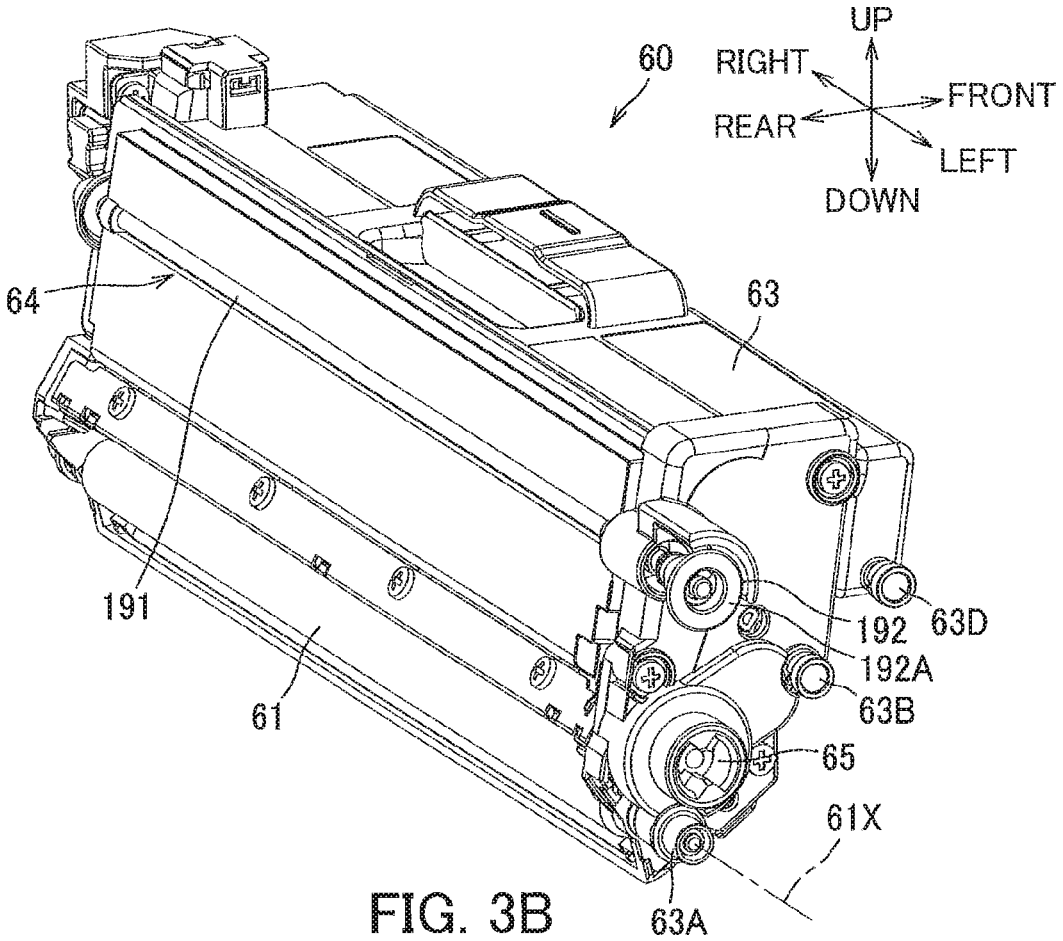
FIG. 3A is a perspective view of a developing cartridge to be accommodated in the image-forming apparatus according to the embodiment.
Figure 3B:
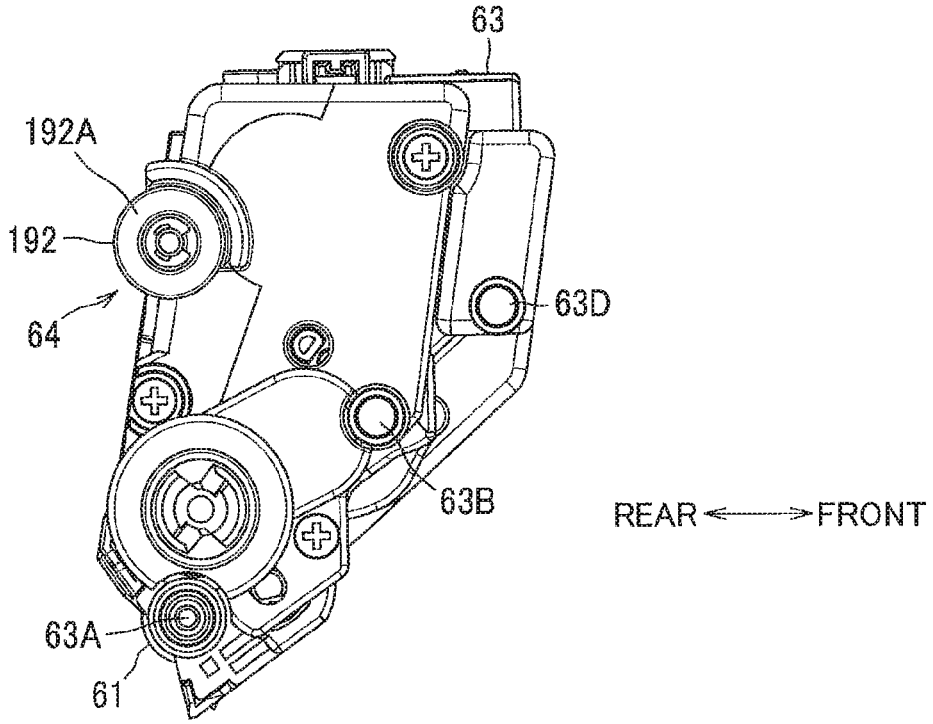
FIG. 3B is a side view of the developing cartridge illustrated in FIG. 3A.
Figure 4A:
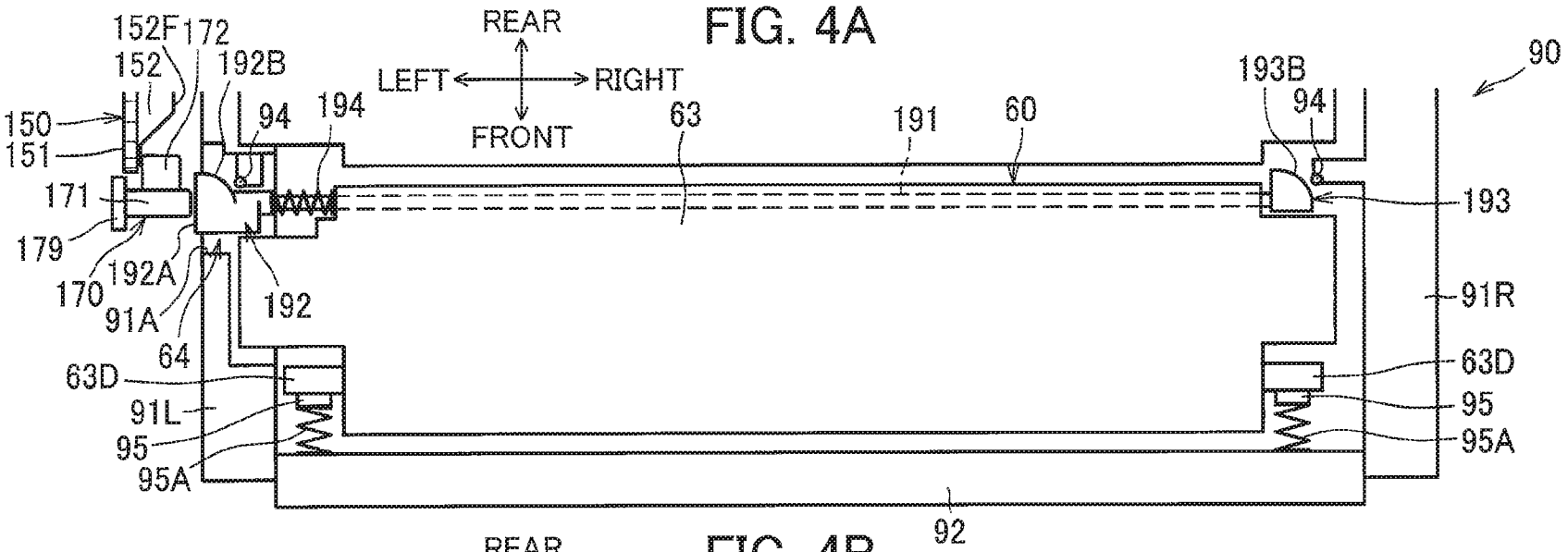
FIG. 4A is a schematic plan view illustrating the developing cartridge and components in the vicinity thereof for description of a slide member of the developing cartridge, and particularly illustrating a state where the cam follower is at a standby position in the image-forming apparatus according to the embodiment.
Figure 4B:
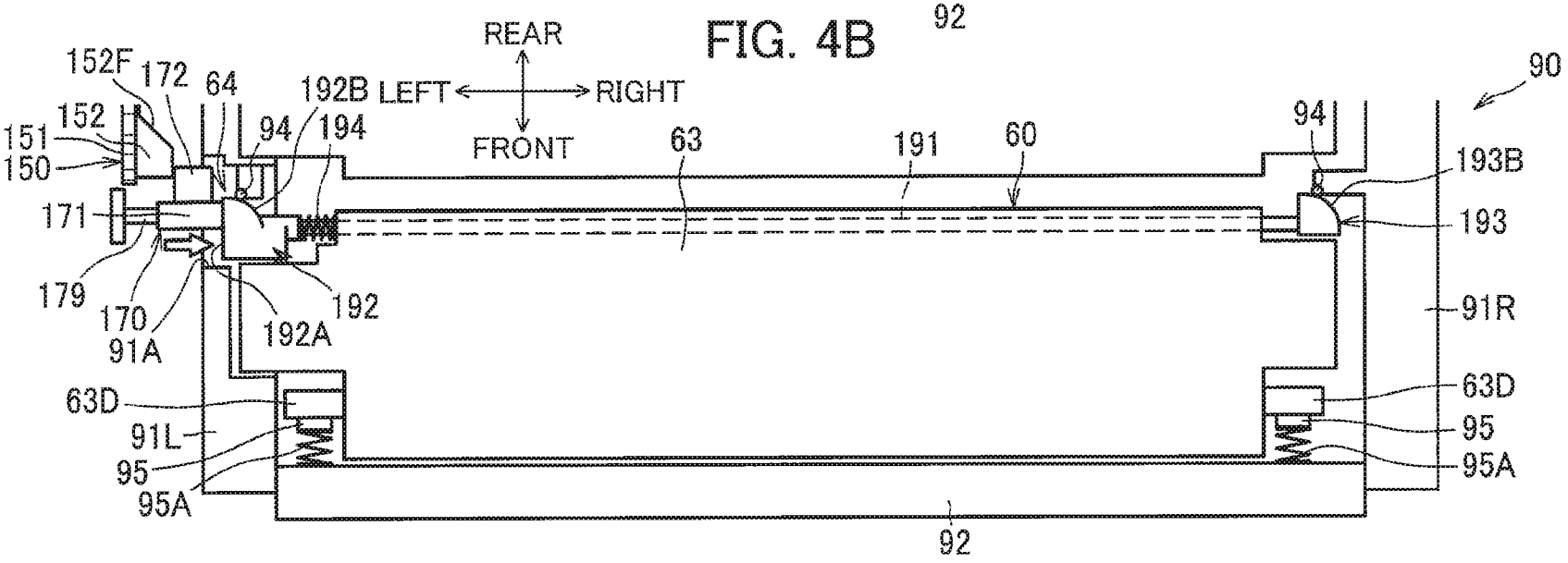
FIG. 4B is a schematic plan view illustrating the developing cartridge and the components in the vicinity thereof for description of the slide member, and particularly illustrating a state where the cam follower is at a protruding position in the image-forming apparatus according to the embodiment.

As illustrated in FIGS. 3A and 3B, each of the developing cartridges 60 (60Y, 60M, 60C, 60K) includes a casing 63, the slide member 64, and a coupling 65.

The casing 63 is configured to store toner of the corresponding color therein. The casing 63 has one side surface in the axial direction (left end surface) provided with a first protruding portion 63A and a second protruding portion 63B.

The first protruding portion 63A is coaxial with the rotation axis 61X of the developing roller 61. That is, the first protruding portion 63A protrudes in the axial direction.

The second protruding portion 63B is positioned away from the first protruding portion 63A by a predetermined distance. In the present embodiment, the second protruding portion 63B is positioned diagonally above the first protruding portion 63A. That is, the second protruding portion 63B is positioned higher than the first protruding portion 63A.

The first and second protruding portions 63A and 63B are provided as rollers rotatable about their axes extending in parallel to the axial direction. Although not illustrated, the first and second protruding portions 63A and 63B are also provided at another side surface of the casing 63 in the axial direction (right end face) at positions symmetrical with the first and second protruding portions 63A and 63B provided at the one side surface (left end surface).

Further, the above-described protrusion 63D configured to be pressed by the pressure members 95 is positioned frontward of the first and second protruding portions 63A and 63B. The protrusion 63D protrudes outward in the axial direction from each side surface of the casing 63 in the axial direction.

The coupling 65 is configured to be engaged with a coupling shaft 119 of a power transmission mechanism 100 described later. Rotational driving force is configured to be inputted to the coupling 65 from the coupling shaft 119.

The slide member 64 is slidably movable in the axial direction relative to the casing 63 upon application of the pressing force from the corresponding cam follower 170.

As illustrated in FIGS. 4A and 4B, the slide member 64 includes: a shaft 191; a first abutment member 192; and a second abutment member 193. The first abutment member 192 is fixed to one end (left end) of the shaft 191, and the second abutment member 193 is fixed to another end (right end) of the shaft 191.

The casing 63 has a hole extending in the axial direction. The shaft 191 extends through the hole and is slidably supported by the casing 63.

The first abutment member 192 has a pressure receiving surface 192A and a sloped surface 192B. The pressure receiving surface 192A is a left end face of the first abutment member 192, that is, an end face thereof in the axial direction. The sloped surface 192B extends from the pressure receiving surface 192A to be sloped with respect to the axial direction.

The pressure receiving surface 192A is configured to be pressed by the corresponding cam follower 170.

When the slide member 64 is pressed in the axial direction by the cam follower 170, the sloped surface 192B abuts against the corresponding counterpart abutment portion 94 of the drawer 90 to urge the developing cartridge 60 (i.e., a corresponding one of the developing cartridges 60Y, 60M, 60C, and 60K) in a direction parallel to the conveying direction of the sheet S (frontward), thereby moving the developing cartridge 60 to the portion as illustrated in FIG. 4B. The sloped surface 192B is sloped in a curved fashion to extend gradually frontward toward the right. That is, the sloped surface 192B is sloped in a direction from the photosensitive drum 50 toward the corresponding developing roller 61 (frontward) as extending in a direction from the one end (left end) to the other end (right end) of the shaft 191 in the axial direction.

The second abutment member 193 has a sloped surface 193B similar to the sloped surface 192B of the first abutment member 192. When the slide member 64 is pressed in the axial direction by the corresponding cam follower 170, the sloped surface 193B abuts against the counterpart abutment portion 94 of the drawer 90 to urge the developing cartridge 60 (i.e., a corresponding one of the developing cartridges 60Y, 60M, 60C, and 60K) in a direction parallel to the conveying direction of the sheet S (frontward), thereby moving the developing cartridge 60 to the position as illustrated in FIG. 4B.

A spring 194 is interposed between the first abutment member 192 and the casing 63 to urge the slide member 64 leftward, i.e., outward in the axial direction. The spring 194 is a compression spring disposed over the shaft 191.

Figure 5:
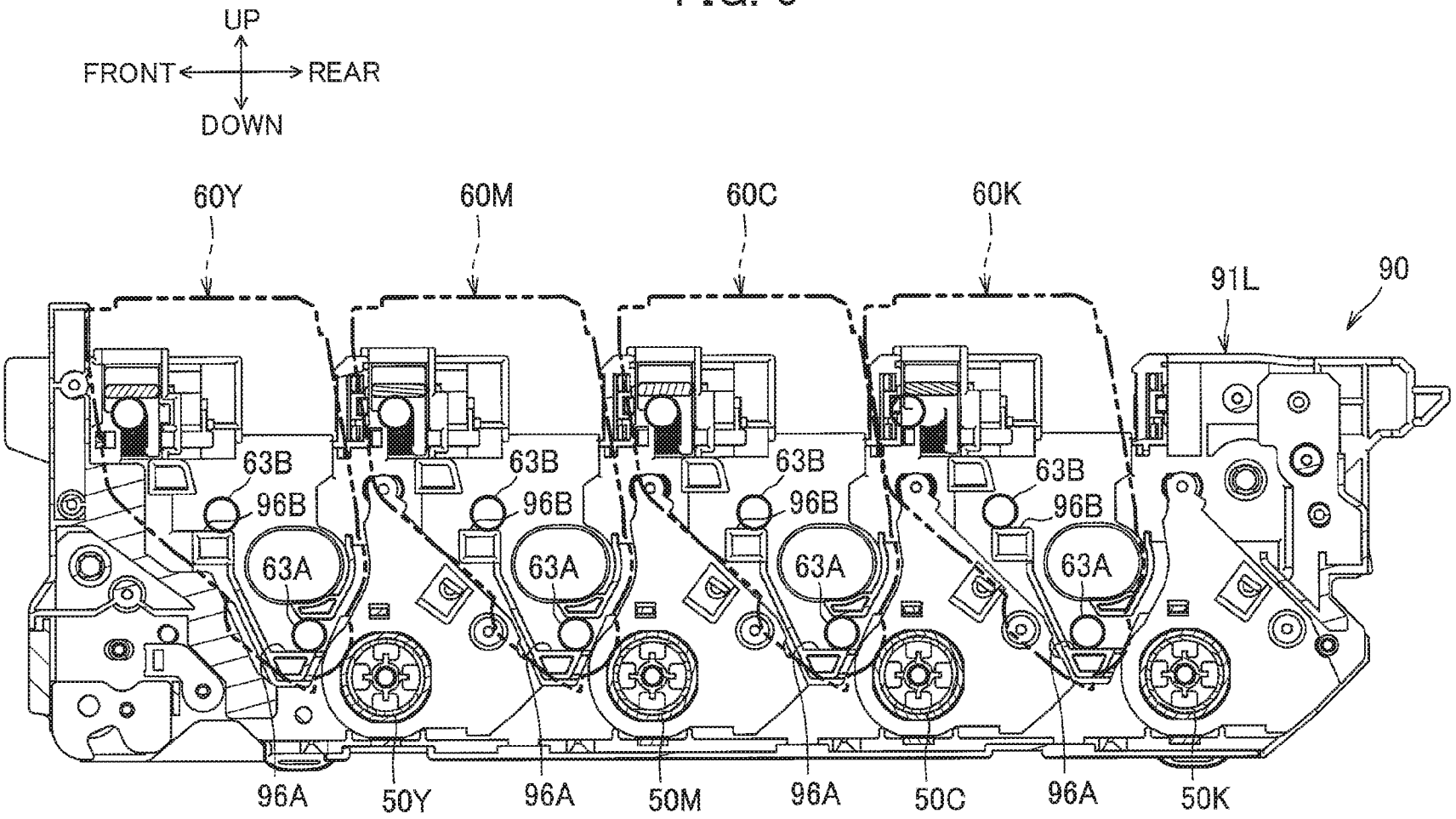
FIG. 5 is a side view of a side frame of the drawer, and particularly illustrating an inner surface of the side frame to which the developing cartridge is attachable in the image-forming apparatus according to the embodiment.

As illustrated in FIG. 5, the side frame 91L of the drawer 90 has an inner surface provided with sets of a first support surface 96A and a second support surface 96B. Each set of the first support surface 96A and the second support surface % B supports the first protruding portion 63A and the second protruding portion 63B of the corresponding developing cartridge 60 from below when the developing roller 61 (i.e., a corresponding one of the developing rollers 61Y, 61M, 61C, and 61K) is moved from the contact position to the separated position. The first support surfaces 96A and the second support surfaces 96B extend in the conveying direction of the sheet S (i.e., from the front to the rear).

The first support surfaces 96A are positioned to support the first protruding portions 63A. Each of the first support surfaces 96A is configured to guide a corresponding one of the developing rollers 61 and to fix a position thereof in the upward/downward direction when the corresponding developing cartridge 60 is attached to the drawer 90.

Each of the second support surfaces 96B is positioned upward of a corresponding one of the first support surfaces 96A to support the second protruding portion 63B.

Although not illustrated, the first and second support surfaces 96A and 96B are also provided at an inner surface of the right side frame 91R at positions symmetrical with the first and second support surfaces 96A and 96B of the left side frame 91L.

Referring to FIG. 5, when the developing roller 61 is positioned at its contact position in contact with the corresponding photosensitive drum 50, the first protruding portion 63A is positioned at a rear region of the corresponding first support surface 96A (see the first protruding portions 63A of the first through third developing cartridges 60Y, 60M, and 60C). When the developing roller 61 is at its separated position away from the corresponding photosensitive drum 50, the first protruding portion 63A is positioned at a front region of the corresponding first support surface 96A (see the first protruding portion 63A of the fourth developing cartridge 60K).

In this way, the first through fourth developing rollers 61Y, 61M, 61C, and 61K are moved frontward, i.e., in a direction opposite to the conveying direction of the sheet S (toward upstream in the conveying direction of the sheet S) when the separation mechanisms move the developing rollers 61Y, 61M, 61C, and 61K from the contact positions to the separated positions, respectively.

Figure 16A:
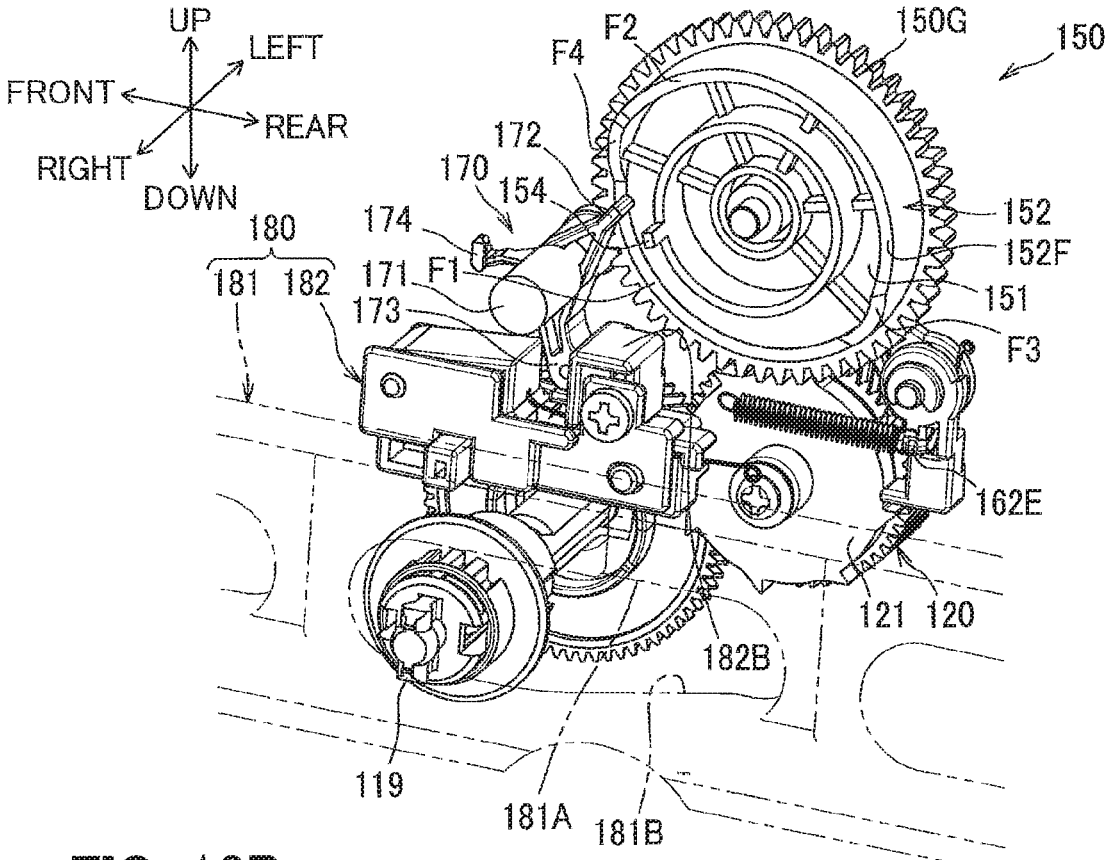
FIG. 16A is a perspective view illustrating the cam, the cam follower and the release member in a state where the cam rotates in a normal rotating direction and the developing roller is at a contact position in the image-forming apparatus according to the embodiment.
Figure 16B:
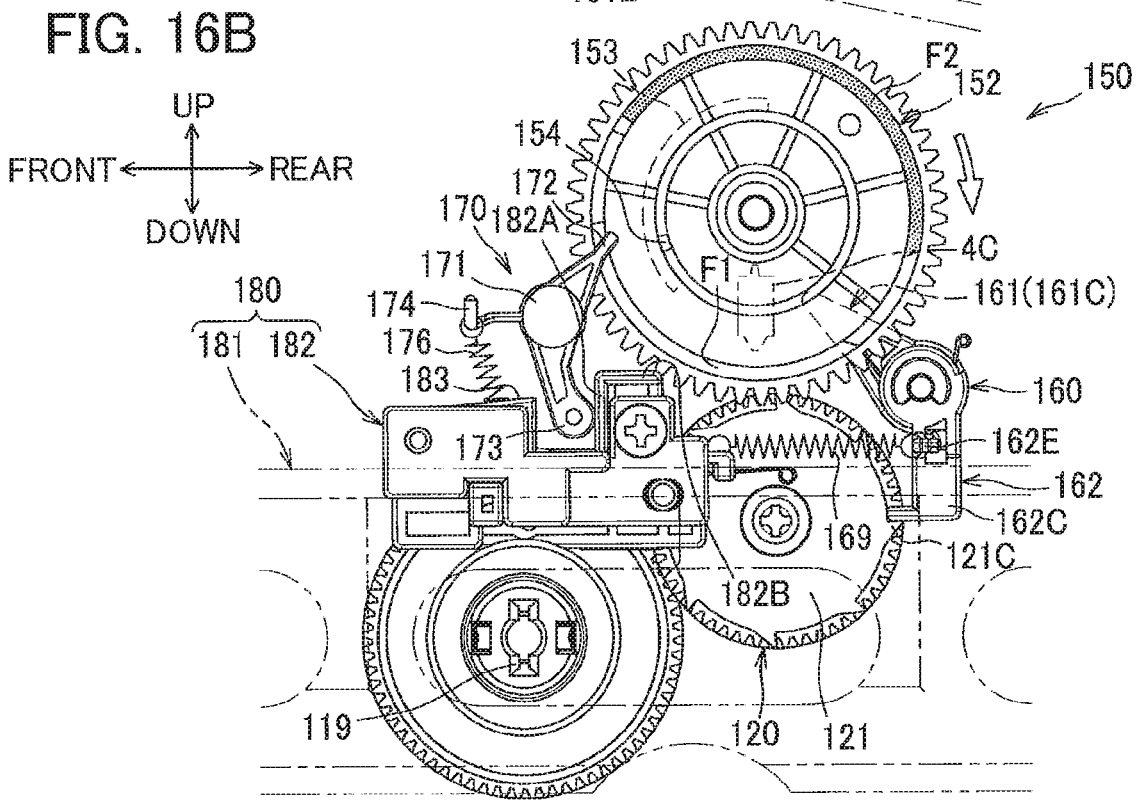
FIG. 16B is a side view illustrating the cam, the cam follower and the release member as viewed in the axial direction in a state where the cam rotates in the normal rotating direction and the developing roller is at the contact position in the image-forming apparatus according to the embodiment.

As illustrated in FIGS. 16A and 16B, each of the cams 150 includes a disc portion 151, a gear portion 150G, a first cam portion 152, a second cam portion 153, and a counterpart detection portion 154. The cam 150 is configured to rotate to move the corresponding developing roller 61 between the contact position and the separated position.

The disc portion 151 is generally circular plate shaped, and is rotatably supported by a support plate 102 (FIG. 7). The support plate is fixed to a frame (not illustrated) of the housing 10.

The gear portion 150G is provided on an outer peripheral surface of the disc portion 151.

The first cam portion 152 constitutes one of components of the corresponding separation mechanism, and protrudes rightward from the disc portion 151. The first cam portion 152 has a protruding end face (right end face) constituting the cam surface 152F as described above.

The cam surface 152F has a first holding surface F1, a second holding surface F2, a first guide surface F3, and a second guide surface F4.

The first holding surface F1 is configured to hold the corresponding cam follower 170 at its standby position.

The second holding surface F2 is configured to hold the corresponding cam follower 170 at its protruding position.

The first guide surface F3 connects the first holding surface F1 and the second holding surface F2 together and is inclined with respect to the first holding surface F1. The first guide surface F3 is configured to guide movement of the corresponding cam follower 170 from the first holding surface F1 to the second holding surface F2 in accordance with the rotation of the cam 150.

The second guide surface F4 connects the second holding surface F2 and the first holding surface F1 together and is inclined with respect to the first holding surface F1. The second guide surface F4 is configured to guide movement of the corresponding cam follower 170 from the second holding surface F2 to the first holding surface F1 in accordance with the rotation of the cam 150.

Note that a dot shading of the first cam portion 152 indicates the second holding surface F2 in FIGS. 10A, 10B, 16B, 17B, 18B, 19B, and 20A through 23.

The second cam portion 153 is configured to provide control to a clutch 120 (see FIG. 6) of the power transmission mechanism 100 to switch a power transmission status of the clutch 120 between an engaging state and a disengaging state in cooperation with a lever 160 (FIG. 8) of the power transmission mechanism 100. The second cam portion 153B protrudes from the disc portion 151 in the axial direction. The second cam portion 153B protrudes leftward from a left side surface of the disc portion 151 in the axial direction. The second cam portion 153 is positioned opposite to the first earn portion 152 with respect to the disc portion 151. That is, the protruding direction of the second cam portion 153 is opposite to the protruding direction of the first cam portion 152. The second cam portion 152 is arcuate in shape as viewed in the axial direction. The second cam portion 152 is integral with and coaxial with the disc portion 151, and hence, the second cam portion 152 rotates together with the first cam portion 151.

The counterpart detection portion 154 is positioned radially inward of the first cam portion 152, and protrudes from the disc portion 151 in the axial direction. The counterpart detection portion 154 is indicative of a phase or an angular position of the cam 150 in a rotating direction. In other words, the counterpart detection portion 154 is indicative of a rotational position of the cam 150. The counterpart detection portion 154 is configured to be detected by separation sensors 4C and 4K described later.

Each of the cam followers 170 includes: a slide shaft portion 171; a contact portion 172; an arm 173; and a spring hook 174.

The slide shaft portion 171 is slidable with respect to the corresponding support shaft 179 fixed to the housing 10. The slide shaft portion 171 is slidably movable in the axial direction.

The contact portion 172 extends from the slide shaft portion 171. The contact portion 172 has an end face in the axial direction facing the cam surface 152F of the first cam portion 152 and contactable with the cam surface 152F.

The arm 173 extends in a direction away from the support shaft 179 and the slide shaft portion 171. The arm 173 extends in a direction different from the extending direction of the contact portion 172, for example extends downward from the slide shaft portion 171.

The spring hook 174 extends in a direction away from the slide shaft portion 171, for example, extends frontward from the slide shaft portion 171.

The first spring 176 is a tension spring having one end portion engaged with the spring hook 174 and another end portion engaged with the support plate 102 at a position lower than the spring hook 174. Hence, the first spring 176 urges the cam follower 170 toward the support plate 102, i.e., in a direction from the protruding position to the standby position. Further, the first spring 176 urges the cam follower 170 in a counterclockwise direction in FIGS. 16A and 16B, i.e., in a direction from the non-operating position to the operating position.

As illustrated in FIG. 7, the cams 150Y, 150M, and 150C have generally the same configuration as one another except that a length of the first cam portion 152A of the cam 150Y in a rotational direction thereof is greater than a length of the first cam portion 152A of each of the remaining cams 150M and 150C in a rotational direction thereof. The cam 150K for the color of black has two first cam portions 152 each having a short length in a rotational direction thereof.

The housing 10 is provided with the separation sensors 4C and 4K respectively corresponding to the colors of black and cyan. Each of the separation sensors 4C and 4K is an example of the sensor of the present disclosure.

The separation sensors 4C and 4K are phase sensors or displacement sensors for detecting phases or rotational positions of the respective cams 150C and 150K. The separation sensors 4C and 4K are configured to output separation signals in response to a timing where the cams 150C and 150K are positioned within a predetermined phase range indicative of the third developing roller 61C and the fourth developing roller 61K being at the separated positions, respectively. The separation sensors 4C and 4K are configured not to output the separation signals in response to a timing where the cams 150 C and 150K are positioned outside of the predetermined phase range. In the present embodiment, for simplification, output of the separation signal will be also referred to as ON (i.e., output of an ON signal, or an ON state of the separation sensor 4C/4K), and non-output of the separation signal will be referred to as OFF (i.e., output of an OFF signal, or an OFF state of the separation sensor 4C/4K). A voltage level of the ON signal may be higher or lower than that of the OFF signal.

Each of the separation sensors 4C and 4K includes a light emitting portion configured to emit detection light, and a light receiving portion configured to receive the detection light from the light emitting portion. In a state where the counterpart detection portion 154 is positioned between the light emitting portion and the light receiving portion to block the detection light so that the light receiving portion cannot receive the detection light, the corresponding separation sensor 4C or 4K outputs the ON signal to the controller 2. On the other hand, in a state where the counterpart detection portion 154 is displaced from a path of the detection light so that the light receiving portion can receive the detection light, the corresponding separation sensor 4C or 4K outputs the OFF signal to the controller 2. Note that each of the cams 150Y and 150M has a part having the same shape as each of the counterpart detection portions 154 of the cams 150C and 150K. However, a separation sensor corresponding to each of these parts is not provided at the housing 10, and therefore, these parts do not function as each of the counterpart detection portion 154 does.

Turning back to FIG. 1, the conveying device 70 is positioned between the sheet tray 21 and the photosensitive drums 50 in the upward/downward direction. The conveying device 70 includes a drive roller 71, a driven roller 72, an endless belt as a conveyer belt 73, and four transfer rollers 74. The conveyer belt 73 is mounted over the drive roller 71 and the driven roller 72 under tension, and has an outer peripheral surface facing each of the photosensitive drums 50. Each of the transfer rollers 74 is positioned within a loop of the conveyer belt 73 to nip the conveyer belt 73 in cooperation with a corresponding one of the photosensitive drums 50. The sheet S is configured to conveyed as the conveyer belt 73 circulates while the sheet S is mounted on an upper portion of the outer peripheral surface of the conveyer belt 73, and at the same time, toner images formed on the photosensitive drums 50 are successively transferred to the sheet S.

The fixing device 80 is positioned rearward of the photosensitive drum 50K and the conveying device 70. The fixing device 80 includes a heat roller 81 and a pressure roller 82 positioned facing the heat roller 81. A pair of conveyer rollers 15 is positioned above the fixing device 80, and a pair of discharge rollers 16 is positioned above the conveyer rollers 15.

In the image-forming unit 30, a peripheral surface of each photosensitive drum 50 is uniformly charged by the corresponding charger 52, and is then exposed to light by the laser beam irradiated from the exposure device 40. Thus, an electrostatic latent image based on image data is formed on the peripheral surface of each photosensitive drum 50.

Further, toner accommodated in the casing 63 of each developing cartridge 60 is carried on a peripheral surface of the developing roller 61 therein, and is then supplied from the developing roller 61 to the peripheral surface of the corresponding photosensitive drum 50 when the developing roller 61 comes into contact with the photosensitive drum 50. Hence, a toner image is formed on the peripheral surface of each photosensitive drum 50.

Subsequently, a toner image formed on each photosensitive drum 50 is transferred onto the sheet S when the sheet S supplied on the conveyer belt 73 moves past the portion between the photosensitive drum 50 and the corresponding transfer roller 74. Then, the toner image transferred onto the sheet S is thermally fixed to the sheet S when the sheet S passes a position between the heat roller 81 and the pressure roller 82.

The sheet S discharged from the fixing device 80 is then discharged onto the discharge tray 13 by the conveyer rollers 15 and the discharge rollers 16.

Next, a structure for driving and stopping the developing rollers 61, and a structure for moving the developing rollers 61 to come into contact with and to be separated from the photosensitive drums 50 will be described in detail.

Figure 6:
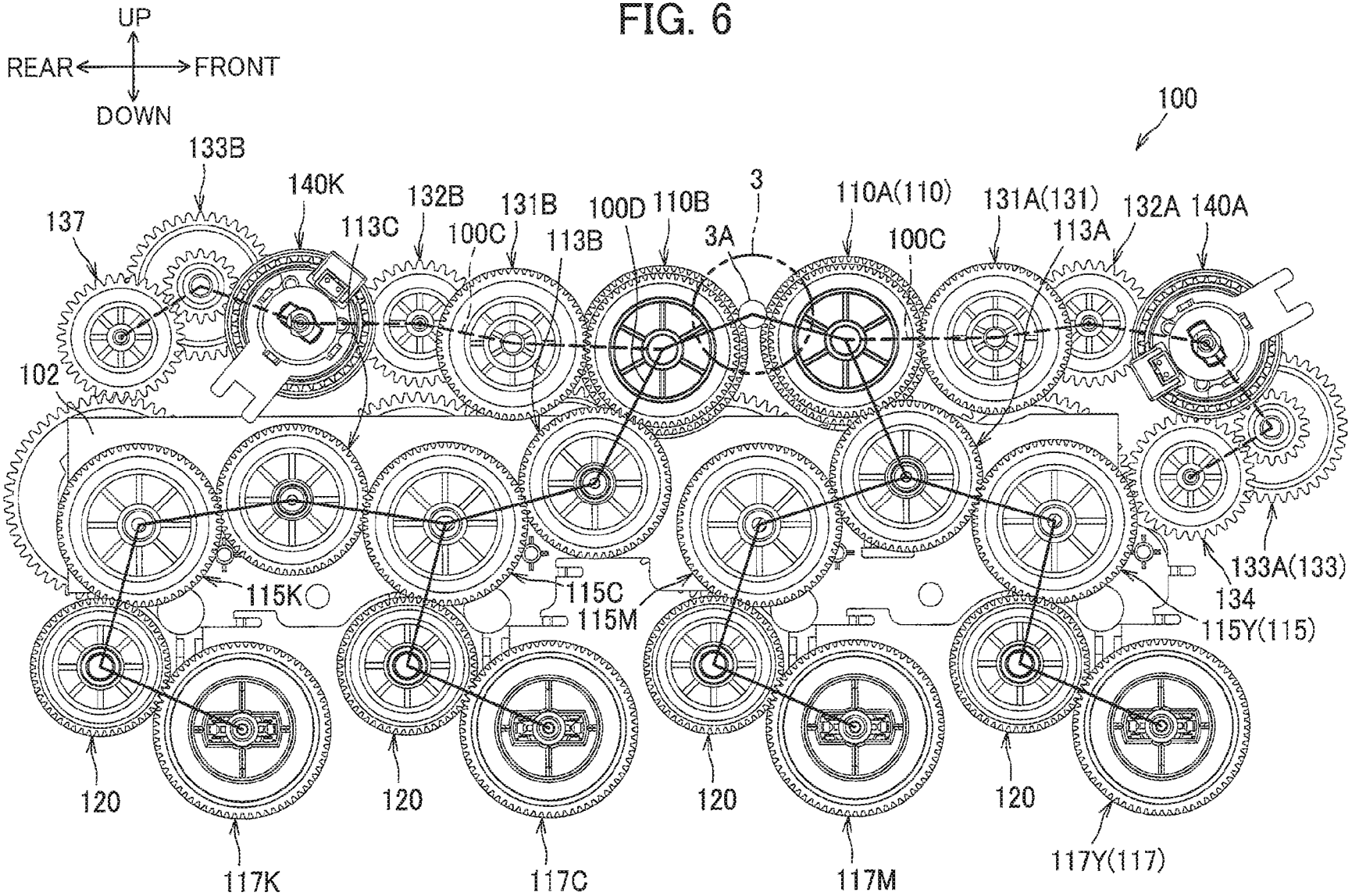
FIG. 6 is a view illustrating a power transmission mechanism as viewed in an axial direction thereof from a left side thereof.

As illustrated in FIG. 6, the image-forming apparatus 1 further includes: a motor 3 configured to drive the developing rollers 61; and the power transmission mechanism 100 configured to transmit driving force of the motor 3 to the first developing roller 61, the second developing roller 61M, the third developing roller 61C, and the fourth developing roller 61K. Each of the above-described cams 150 (constituting part of the corresponding separation mechanism) is mechanically connected to the power transmission mechanism 100. The power transmission mechanism 100 is configured not to transmit the driving force of the motor 3 to the first developing roller 61Y, the second developing roller 61M, the third developing roller 61C, and the fourth developing roller 61K when these developing rollers 61 are at their respective separated positions.

Figure 8:
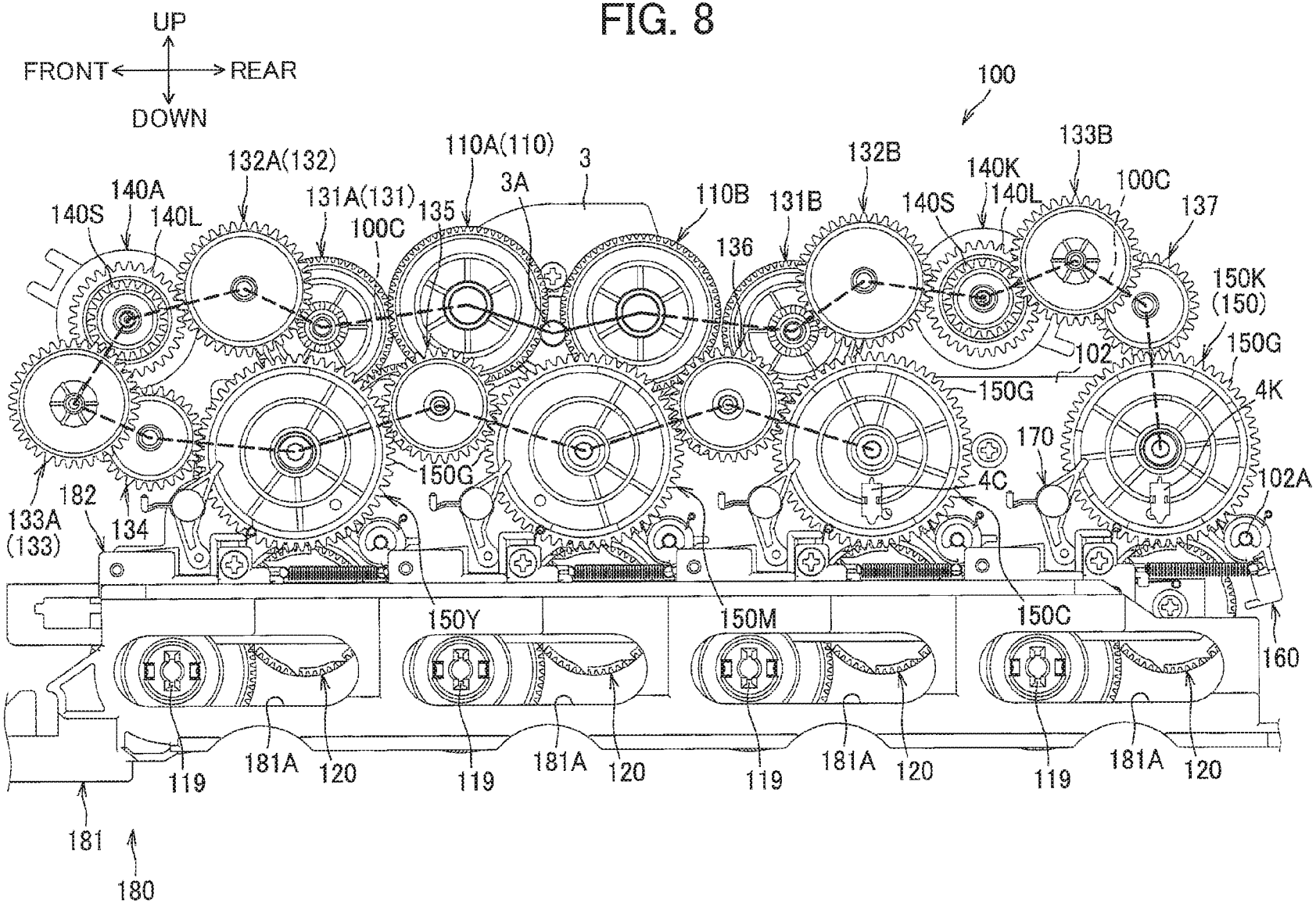
FIG. 8 is a view illustrating the power transmission mechanism as viewed in the axial direction thereof from a right side thereof.

As illustrated in FIG. 6, the power transmission mechanism 100 includes: a power transmission gear train 100D configured to transmit the driving force of the motor 3 to the respective developing rollers 61; and a transmission control gear train 100C configured to control transmission of the driving force of the power transmission gear train 100D. The power transmission gear train 100D is mechanically connected to the transmission control gear train 100C. In FIGS. 6 and 8, meshing engagement of the gears in the power transmission gear train 100D is indicated by a bold solid line, and meshing engagement of the gears in the transmission control gear train 100C is indicated by a bold broken line.

The power transmission gear train 100D includes: two first idle gears 110 (110A, 110B); three second idle gears 113A, 113B, and 113C; four third idle gears 115 (115Y, 115M, 115C, 115K); four clutches 120; and four coupling gears 117 (117Y, 117M, 117C, 117K). Each of these gears constituting the power transmission gear train 100D is supported by the support plate 102 or the frame (not illustrated) of the housing 10 so as to be rotatable about an axis extending in the axial direction.

The motor 3 includes an output shaft 3A. A gear (not illustrated) is concentrically fixed to the output shaft 3A.

The third idle gears 115Y, 115M, 115C, 115K are provided in one-to-one correspondence with each of the four colors, and are arrayed in this order in a front-to-rear direction.

The four clutches 120 have the same structure as one another. Each of the clutches 120 is in meshing engagement with a corresponding one of the third idle gears 115 (a corresponding one of the third idle gears 115Y, 115M, 115C, and 115K) to receive the driving force therefrom. The structure of each clutch 120 will be described later in detail. The clutches 120 are examples of the clutch of the present disclosure.

Each of the coupling gears 117 is in meshing engagement with a corresponding one of the clutches 120. Each coupling gear 117 includes the coupling shaft 119 rotatable integrally therewith (FIG. 7). The coupling shaft 119 is movable in the axial direction in interlocking relation to the opening/closing movement of the cover 11. The coupling shaft 119 is configured to be engaged with the coupling 65 (FIG. 3A) of the corresponding developing cartridge 60 in accordance with the closing motion of the cover 11.

In the power transmission gear train 100D, the coupling gear 117Y for the color of yellow is configured to receive the driving force from the motor 3 through the first idle gear 110A, the second idle gear 113A, the third idle gear 115Y, and the clutch 120.

The coupling gear 117M for the color magenta is configured to receive the driving force from the motor 3 through the first idle gear 110A, the second idle gear 113A, the third idle gear 115M, and the clutch 120.

The coupling gear 117C for the color of cyan is configured to receive the driving force from the motor 3 through the first idle gear 110B, the second idle gear 113B, the third idle gear 115C, and the clutch 120.

The coupling gear 117K for the color of black is configured to receive the driving force from the motor 3 through the first idle gear 110B, the second idle gear 113B, the third idle gear 115C, the second idle gear 113C, the third idle gear 115K, and the clutch 120.

As illustrated in FIGS. 7 and 8, the transmission control gear train 100C includes: two fourth idle gears 131 (131A, 131B); two fifth idle gears 132 (132A, 132B); a YMC clutch 140A; a K clutch 140K; two sixth idle gears 133 (133A, 133B); a seventh idle gear 134; an eighth idle gear 135; a ninth idle gear 136; a tenth idle gear 137; and the cams 150 (150Y, 150M, 150C, 150K). These gears constituting the transmission control gear train 100C are supported by the support plate 102 or the frame (not illustrated) of the housing 10 so as to be rotatable about their axes extending in the axial direction. The YMC clutch 140A and the K clutch 140K are examples of the clutch of the present disclosure.

Of the two fifth idle gears 132, the fifth idle gears 132A is positioned frontward of the fourth idle gear 131A, and the fifth idle gear 132B is positioned rearward of the fourth idle gear 131B. The fifth idle gear 132A is in meshing engagement with the fourth idle gear 131A, and the fifth idle gear 132B is in meshing engagement with the fourth idle gear 131B.

The YMC clutch 140A is configured to change-over transmission and cut-off of the driving force to the cams 150 with respect to the color of yellow, magenta, and cyan in the transmission control gear train 100C. That is, the YMC clutch 140A is configured to perform switching of the cams 150Y, 150M, and 150C between their rotating states and non-rotating states. The YMC clutch 140A includes a large diameter gear 140L and a small diameter gear 140S whose number of gear teeth is smaller than the number of gear teeth of the large diameter gear 140L. The YMC clutch 140A is positioned frontward of the fifth idle gear 132A, and the large diameter gear 140L of the YMC clutch 140A is in meshing engagement with the fifth idle gear 132A.

An electromagnetic clutch is available as the YMC clutch 140A. Upon receipt of power supply (turning ON), the large diameter gear 140L and the small diameter gear 140S integrally rotate together, and upon halting of the power supply (turning OFF), the large diameter gear 140L idly rotates to prevent rotation of the small diameter gear 140S.

The K clutch 140K has the same structure as that of the YMC clutch 140A. The K clutch 140K is configured to perform change-over between transmission and cut-off of the driving force to the cam 150 with respect to the color of black (i.e., the cam 150K) in the transmission control gear train 100C. As in the YMC clutch 140A, the K clutch 140K includes the large diameter gear 140L and the small diameter gear 140S whose number of gear teeth is smaller than that of the large diameter gear 140L. The K clutch 140K is positioned rearward of the fifth idle gear 132B, and the large diameter gear 140L of the K clutch 140K is in meshing engagement with the fifth idle gear 132B.

Of the two sixth idle gears 133, the sixth idle gear 133A is positioned frontward of the YMC clutch 140A, and the sixth idle gear 133B is positioned rearward of the K clutch 140K. The sixth idle gear 133A is in meshing engagement with the small diameter gear 140S of the YMC clutch 140A, and the sixth idle gear 133B is in meshing engagement with the small diameter gear 140A of the K clutch 140K.

The seventh idle gear 134 is positioned between the sixth idle gear 133A and the cam 150Y. The seventh idle gear 134 is in meshing engagement with the sixth idle gear 133A and the gear portion 150G of the cam 150Y.

The eighth idle gear 135 is positioned between the cam 150Y and the cam 150M. The eighth idle gear 135 is in meshing engagement with the gear portion 150G of the cam 150Y and the gear portion 150G of the cam 150M.

The ninth idle gear 136 is positioned between the cam 150M and the cam 150C. The ninth idle gear 136 is in meshing engagement with the gear portion 150G of the cam 150M and the gear portion 150G of the cam 150C.

The tenth idle gear 137 is positioned between the sixth idle gear 133B and the cam 150K. The tenth idle gear 137 is in meshing engagement with the sixth idle gear 133B and the gear portion 150G of the cam 150K.

In the transmission control gear train 100C, the yellow cam 150Y is configured to receive the driving force of the motor 3 through the first idle gear 110A, the fourth idle gear 131A, the fifth idle gear 132A, the YMC clutch 140A, the sixth idle gear 133A, and the seventh idle gear 134.

Further, the magenta cam 150M is configured to receive the driving force from the yellow cam 150Y through the eighth idle gear 135.

Further, the cyan cam 150C is configured to receive the driving force from the magenta cam 150M through the ninth idle gear 136.

The cams 150Y, 150M, and 150C are configured to rotate concurrently upon power supply to the YMC clutch 140A, and the cams 150Y, 150M, and 150C are configured to stop rotating upon halting of the power supply to the YMC clutch 140A.

On the other hand, the black cam 150K is configured to receive the driving force of the motor 3 through the first idle gear 110B, the fourth idle gear 131B, the fifth idle gear 132B, the K clutch 140K, the sixth idle gear 133B, and the tenth idle gear 137.

The cam 150K is configured to rotate upon power supply to the K clutch 140K, and the cam 150K is configured to stop rotating upon halting of the power supply to the K clutch 140K.

Next, the release member 180 will be described.

As illustrated in FIG. 7, the release member 180 is configured to move each of the coupling shafts 119 in the axial direction in interlocking relation to the opening movement of the cover 11, and is configured to move each of the cam followers 170 from the operating position to the non-operating position.

Figure 9A:
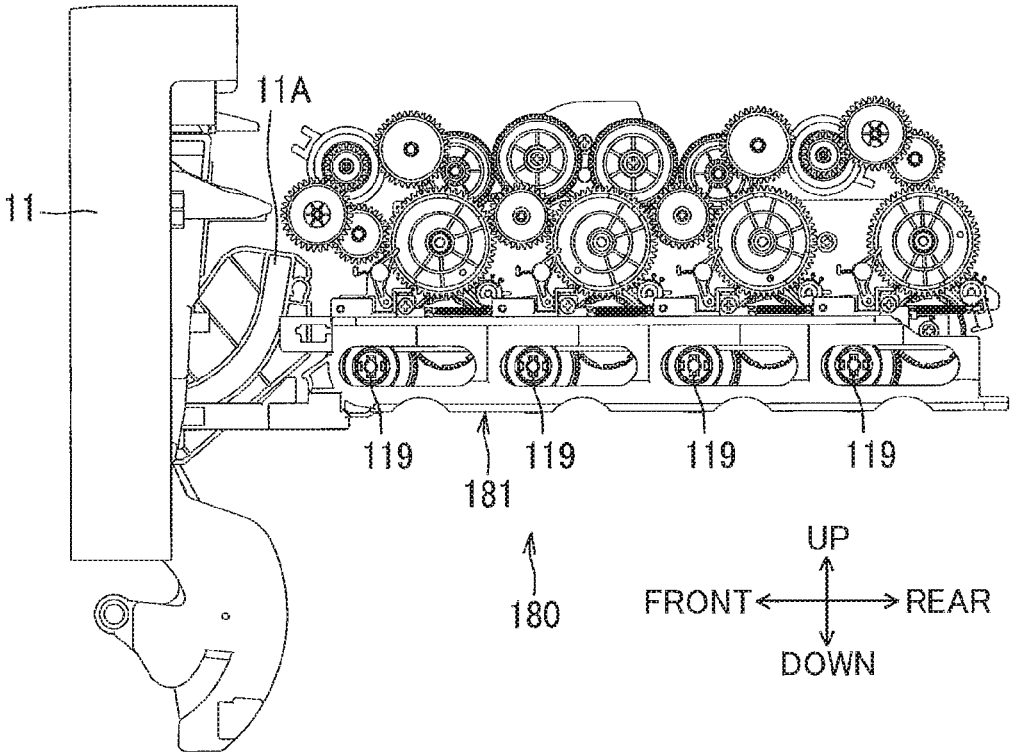
FIG. 9A is a side view illustrating a release member when a cover is at a closed position in the image-forming apparatus according to the embodiment.
Figure 9B:
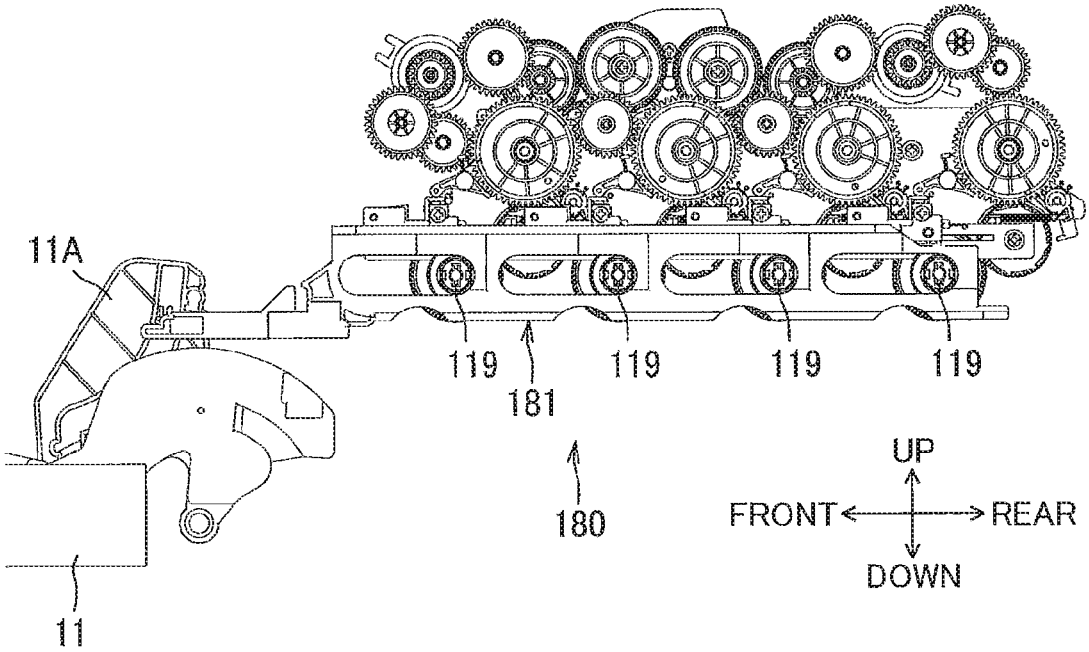
FIG. 9B is a side view illustrating the release member when the cover is at an open position in the image-forming apparatus according to the embodiment.

As illustrated in FIG. 9A, the release member 180 is connected to the cover 11 through a link 11A. The release member 180 is linearly movable frontward in accordance with the movement of the cover 11 from the closed position illustrated in FIG. 9A to the open position illustrated in FIG. 9B. That is, the release member 180 is movable in interlocking relation to the opening/closing movement of the cover 11.

Figure 10A:
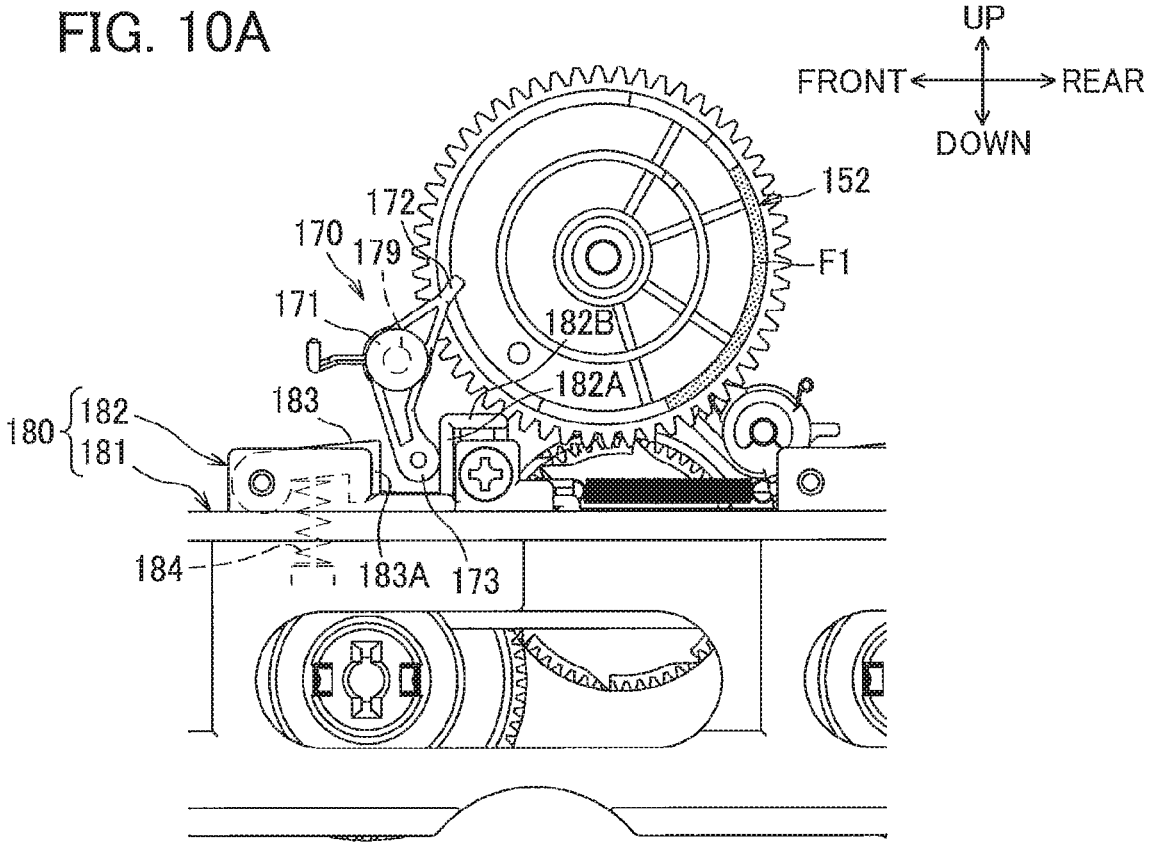
FIG. 10A is a view for description of a stopper and particularly illustrating the stopper at a restricting position where the stopper is free from urging by an arm in the image-forming apparatus according to the embodiment.
Figure 10B:
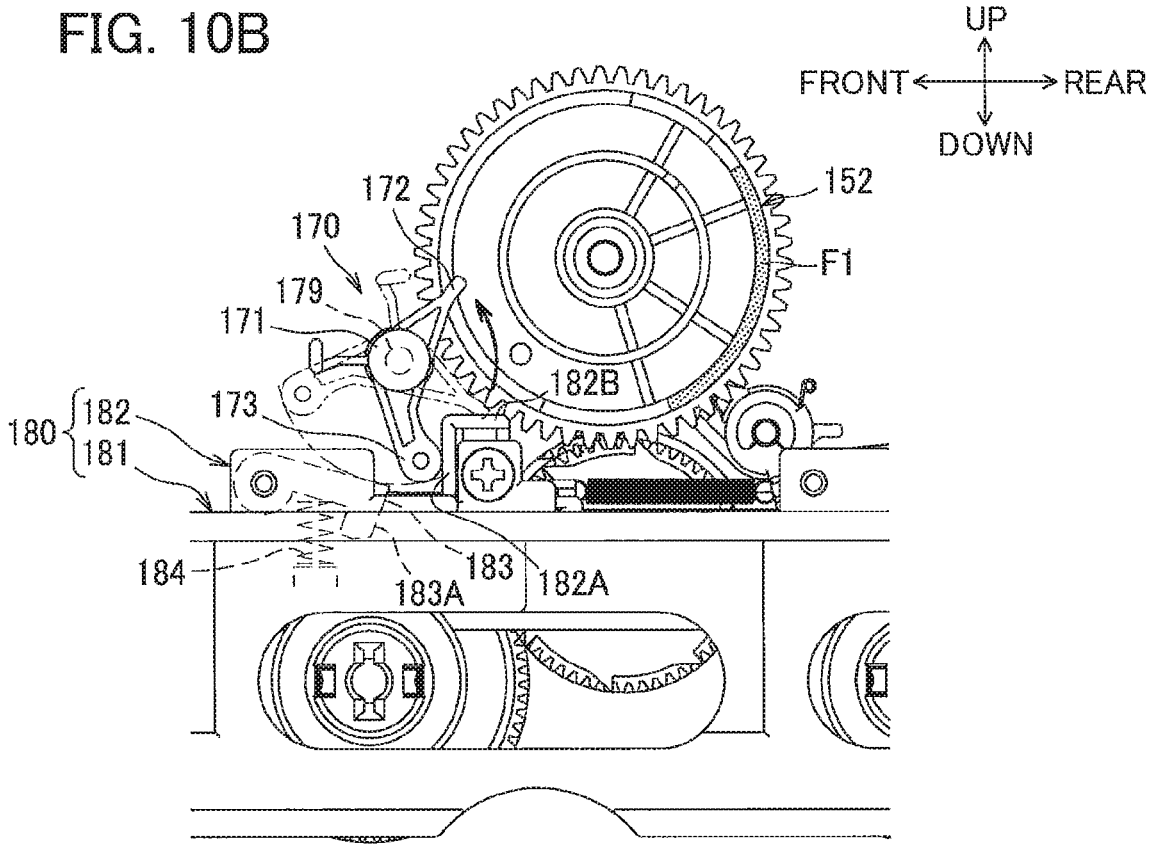
FIG. 10B is a view for description of the stopper and particularly illustrating the stopper pivotally moved to a non-restricting position by urging force from the arm in the image-forming apparatus according to the embodiment.

Turning back to FIG. 7, the release member 180 includes: a coupling acting member 181 configured to move the coupling shafts 119; and four cam follower acting members 182 configured to move the cam followers 170. Further, the image-forming apparatus 1 includes four stoppers 183 and four stopper urging springs 184 as illustrated in FIGS. 10A and 10B. Each of the stoppers 183 is movable in accordance with the linear movement of the release member 180 and is pivotally movable with respect to the release member 180. Each of the stopper urging springs 184 urges a corresponding one of the stoppers 183. The coupling acting member 181 is supported by the housing 10 so as to be linearly movable in the frontward/rearward direction in which the photosensitive drums 50 are juxtaposed.

The coupling acting member 181 has a plurality of through-holes 181A those being in one-to-one correspondence with the coupling shafts 119. The coupling acting member 181 includes a plurality of coupling retraction cams 181B those being in one-to-one correspondence with the coupling shafts 119. Each of the through-holes 181A allows a tip end portion of a corresponding one of the coupling shafts 119 to extend therethrough, so that the corresponding coupling shaft 119 is engageable with the coupling 65. Each of the coupling retraction cams 181B has a surface sloped leftward in the rearward direction. Hence, each coupling retraction cam 181B moves the corresponding coupling shaft 119 in the axial direction (leftward) to disengage the coupling shaft 119 from the coupling 65 in accordance with the frontward movement of the release member 180.

Each of the four cam follower acting members 182 is provided in one-to-one correspondence with the four cam followers 170. Each cam follower acting member 182 is fixed to the coupling acting member 181 and is linearly movable in the frontward/rearward direction together with the coupling acting member 181.

As illustrated in FIGS. 10A and 10B, each cam follower acting member 182 includes: a release engagement portion 182A; and a cam follower holding portion 182B.

The release engagement portion 182A extends upward at a position rearward of the arm 173 of the corresponding cam follower 170 that is positioned at the operating position. Hence, each release engagement portion 182A is configured to contact and press the corresponding arm 173 to pivotally move the corresponding cam follower 170 from the operating position to the non-operating position when the cover 11 is moved from the closed position to the opening position causing linear frontward movement of the release member 180. Further, in a case where the motor 3 rotates in a normal rotating direction to allow the first cam portion 152 to guide the corresponding contact portion 172 in a state where the cover 11 is at the closed position, the release engagement portion 182A is in contact with the arm 173 to prevent the cam follower 170 from pivotally moving about an axis of the support shaft 179.

Each of the cam follower holding portions 182B extends rearward from an upper end of a corresponding one of the release engagement portions 182A. The cam follower holding portion 182B has a surface facing upward. The arm 173 of the cam follower 170 that is at the non-operating position is in contact with the upper surface of the cam follower holding portion 182B (FIGS. 18A and 18B) to maintain a posture of the cam follower 170 when the cover 11 is moved from the closed position to the open position.

Each stopper 183 has a front end portion pivotally movably supported by the corresponding cam follower acting portion 182. Specifically, the stopper 183 is pivotally movable in upward/downward direction about an axis extending in the axial direction between a restricting position as illustrated in FIG. 10A and a non-restricting position as illustrated in FIG. 10B.

Each stopper urging spring 184 always urges the corresponding stopper 183 in a direction from the non-restricting position to the restricting position. In FIGS. 10A and 10B, a compression coil spring is illustrated as the stopper urging spring 184, and is positioned below the stopper 183. However, a torsion spring is also available as the stopper urging spring 184. When the stopper 183 is positioned at its uppermost position, the upper surface of the stopper 183 is positioned lower than the upper surface of the cam follower acting portion 182B.

In a case where the cover 11 moves from the open position to the closed position while the cam follower 170 is at the operating position, each of the stoppers 183 is positioned at the restricting position so that the corresponding arm 173 is positioned between the release engagement portion 182A and the stopper 183 as illustrated in FIG. 10A. Hence, as illustrated in FIG. 20B, the arm 173 can be brought into contact with the stopper 183 to prevent the cam follower 170 from pivotally moving from the operating position to the non-operating position when the cam 160 rotates in a reverse rotating direction by the rotation of the motor in its reverse rotating direction. The restricting position is an example of the first position of the present disclosure.

On the other hand, as illustrated in FIG. 10B, in a case where the cover 11 moves from the open position to the closed position while the cam follower 170 is at the non-operating position, the cam follower 170 may be pivotally moved from the non-operating position toward the operating position by the urging force of the first spring 176. At that time, the stopper 83 is pressed by the arm 173 and pivotally moves from the restricting position to the non-restricting position to allow the cam follower 170 to be further pivotally moved toward the operating position by the urging force of the first spring. The non-restricting position is an example of the second position of the present disclosure.

Next, structures and functions of the clutches 120 will be described.

Figure 11A:
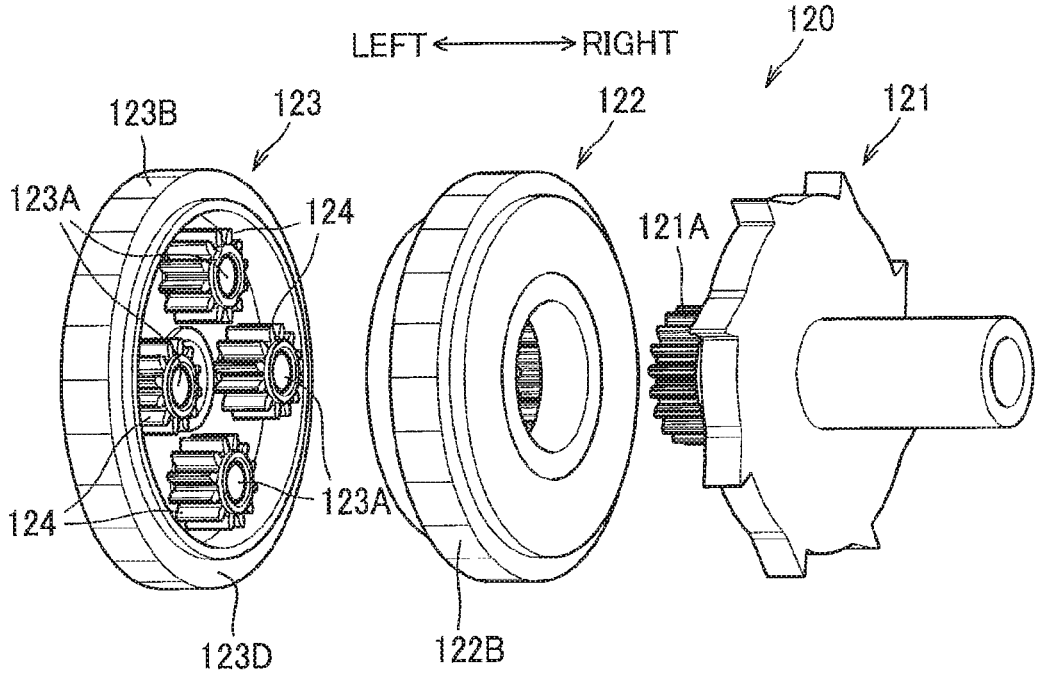
FIG. 11A is an exploded perspective view illustrating a clutch as viewed from a sun gear side thereof in the image-forming apparatus according to the embodiment.
Figure 11B:
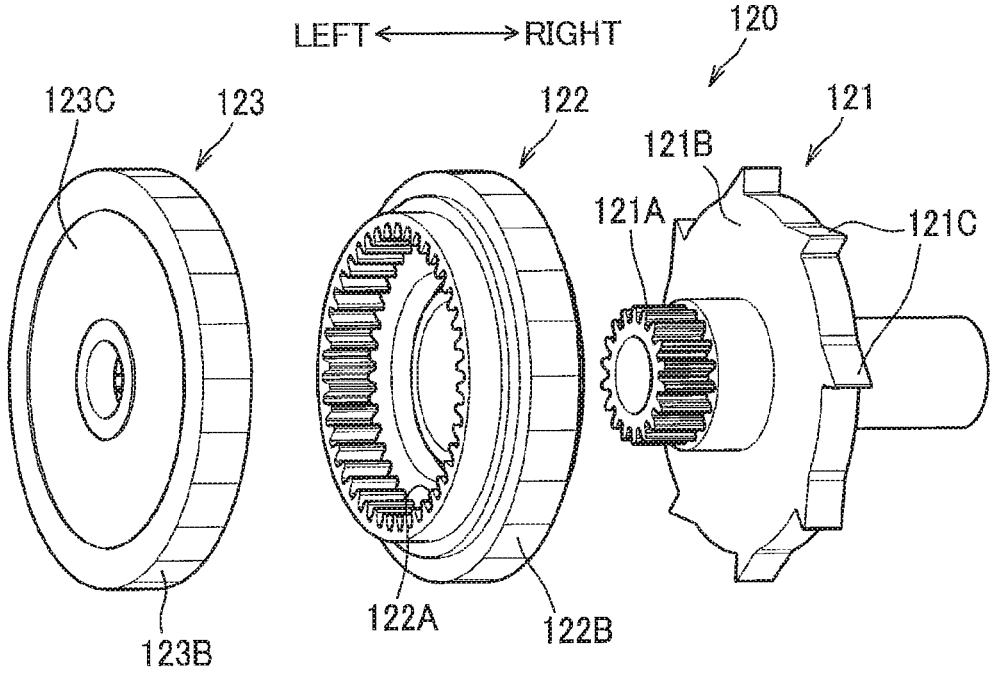
FIG. 11B is an exploded perspective view illustrating the clutch as viewed from a carrier side thereof in the image-forming apparatus according to the embodiment.

As illustrated in FIGS. 11A and 11B, each clutch 120 includes a planetary gear mechanism. The clutch 120 is configured to switch the power transmission status between the engaging state where the clutch 120 engages transmission of the driving force from the motor 3 to the developing roller 61 and the disengaging state where the clutch 120 disengages the transmission of the driving force from the motor 3 to the developing roller 61. Specifically, the clutch 120 includes: a sun gear 121 rotatable about an axis thereof; a ring gear 122; a carrier 123; and a plurality of (four) planetary gears 124 supported by the carrier 123. The ring gear 122 and the carrier 123 are rotatable coaxially about the axis of the sun gear 121.

The sun gear 121 includes: a gear portion 121A; a disc portion 121B rotatable integrally with the gear portion 121A; and a plurality of pawls 121C provided at an outer peripheral surface of the disc portion 121B. The pawls 121C have acute tip end portions each of which is inclined toward upstream in a rotational direction of the sun gear 121 along the outer peripheral surface.

The ring gear 122 has an annular shape having an inner peripheral surface provided with an inner gear 122A and an outer peripheral surface provided with an input gear 122B.

The carrier 123 includes: a circular portion 123C; an annular portion 123D extending from an inner surface of the circular portion 123C; four shaft portions 123A each extending from the inner surface of the circular portion 123C; and an output gear 123B provided at an outer peripheral surface of the annular portion 123D.

Each of the four planetary gears 124 is rotatably supported by a corresponding one of the four shaft portions 123A. Each planetary gear 124 is in meshing engagement with the gear portion 121A of the sun gear 121, and with the inner gear 122A of the ring gear 122.

As illustrated in FIG. 6, the input gear 122B of each clutch 120 is in meshing engagement with the corresponding third idle gear 115, and the output gear 123B is in meshing engagement with the corresponding coupling gear 117.

In a state where the rotation of the sun gear 121 is stopped, the driving force inputted into the input gear 122B can be transmitted to the output gear 123B (the engaging state).

On the other hand, in a state where the sun gear 121 is allowed to rotate, the driving force inputted into the input gear 122B cannot be transmitted to the output gear 123B (the disengaging state).

In a state where the clutch 120 is at the cut-off state and the driving force is inputted into the input gear 122 while load is imparted on the output gear 123B, the output gear 123B does not rotate and the sun gear 121 idly rotates.

As illustrated in FIG. 8, the power transmission mechanism 100 further includes a plurality of (four) levers 160 corresponding to the respective four colors of yellow, magenta, cyan, and black. Four support shafts 102A are fixed to and extends from the support plate 102, and each lever 160 is pivotally movably supported by a corresponding one of the four support shafts 102A.

Each lever 160 is configured, in cooperation with the corresponding cam 150, to engage the sun gear 121 of the planetary gear mechanism in the corresponding clutch 120 to prevent the rotation of the sun gear 121 to provide the engaging state, and to disengage from the sun gear 121 to provide the disengaging state. That is, each lever 160 is configured to switch the clutch between the engaging state and the disengaging state.

Figure 12A:
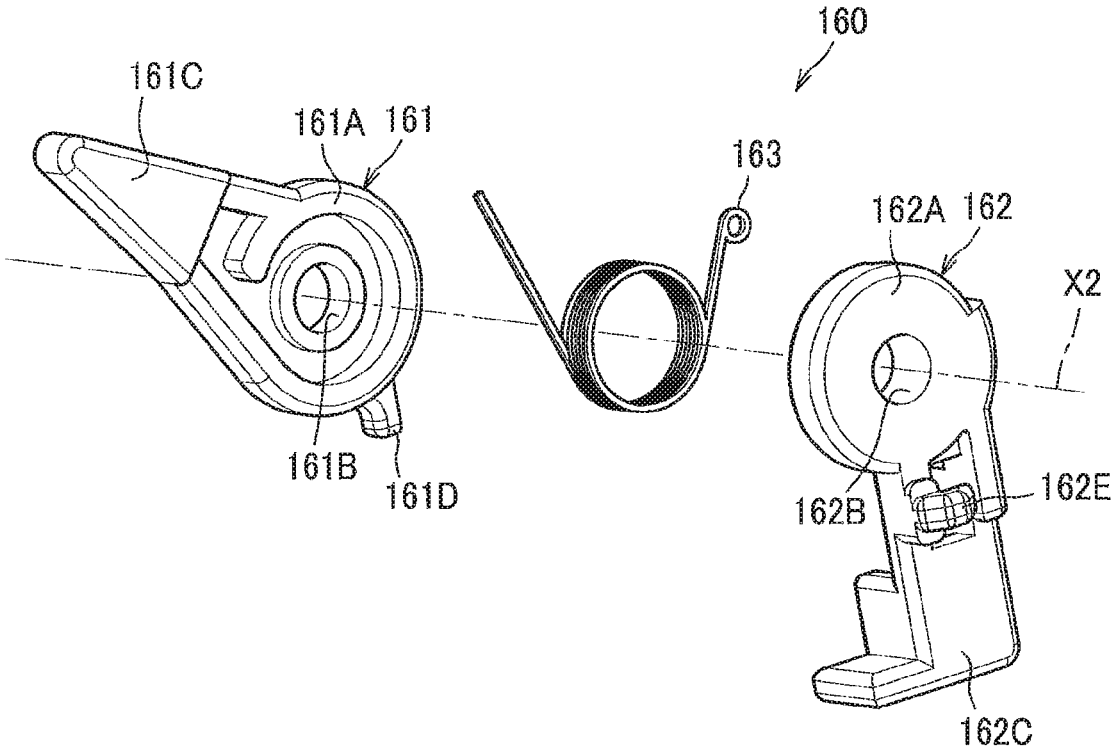
FIG. 12A is an exploded perspective view of a lever including a first lever and a second lever in the image-forming apparatus according to the embodiment.

Specifically, as illustrated in FIG. 12A, each lever 160 includes: a first lever 161; a second lever 162; and a second spring 163.

The first lever 161 is pivotally movable about a pivot axis X2 which is a center axis of the corresponding support shaft 102A. The first lever 161 is contactable with the corresponding second cam portion 153. The first lever 161 includes: a support portion 161A having a through-hole 161B into which the support shaft 102A is fitted; a first arm 161C extending from the support portion 161A; and a protrusion 161D protruding from the support portion 161A in a direction opposite to the extending direction of the first arm 161C.

Figure 12B:
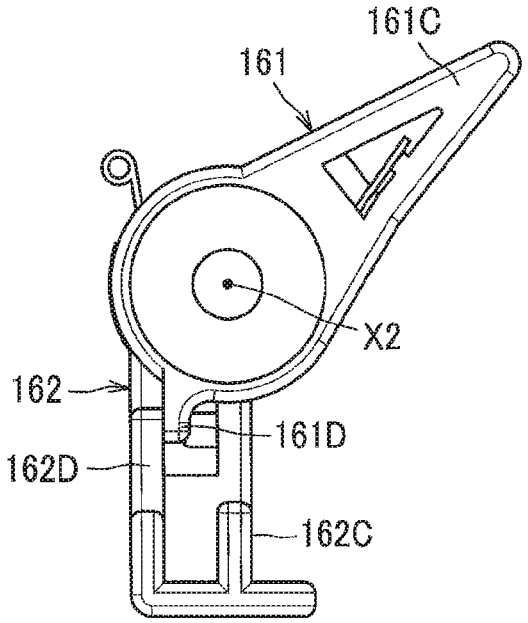
FIG. 12B is a view of the lever and particularly illustrating the first lever whose pivotal movement is restrained.
Figure 12C:
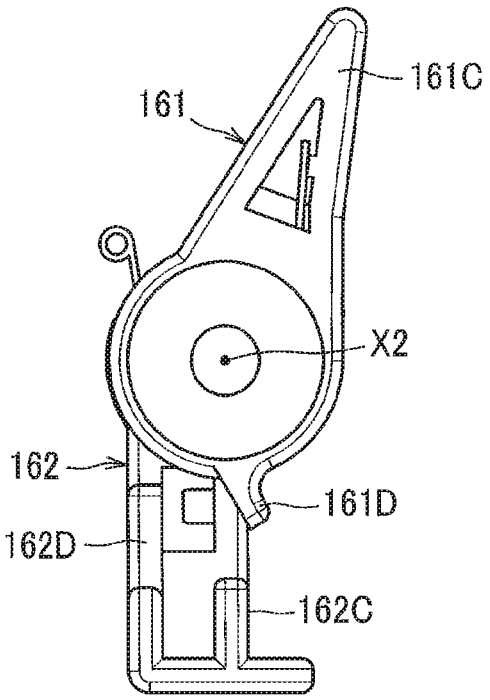
FIG. 12C is a view of the lever and particularly illustrating the first lever pivotally moved relative to the second lever.

The second lever 162 is pivotally movable about the pivot axis X2. The second lever 162 is engageable with the corresponding sun gear 121 which is one of the components of the clutch 120. The second lever 162 is assembled to the first lever 161, and is pivotally movable relative to the first lever 161 about the pivot axis X2 as illustrated in FIGS. 12B and 12C. In other words, the first lever 161 is assembled to the second lever 162, and is pivotally movable relative to the second lever 162 about the pivot axis X2. A pivotally moved position of the first lever 161 against the urging force of the second spring 163 as illustrated in FIG. 12C will be referred to as "pivotally moved position".

The second lever 162 includes: a support portion 162A having a through-hole 162B into which the support shaft 102A is fitted; a second arm 162C extending from the support portion 162A; a stop portion 162D; and a spring hook portion 162E. The stop portion 162D protrudes from the second arm 162C in an extending direction of the pivot axis X2. As illustrated in FIG. 12B, the stop portion 162D is contactable with the protrusion 161D of the first lever 161 so that pivotal movement of the second lever 162 in one direction relative to the first lever 161 is restricted.

The second spring 163 is a torsion spring, and is configured to urge the first lever 161 in a direction opposite to the above-described one direction so that the protrusion 161D is urged toward the stop portion 162D. In other words, the second spring 163 is configured to urge the second lever 162 so that the stop portion 162D of the second lever 162 comes in contact with the protrusion 161D of the first lever 161, thereby preventing the first lever 161 from pivotally moving relative to the second lever 162.

In a state where the first lever 161 and the second lever 162 are assembled together in each lever 160, the tip end portion of the second arm 162C extends toward an outer peripheral surface of the disc portion 121B of the corresponding sun gear 121. As illustrated in FIG. 16B, a third spring 169 which is a tension spring is provided. The third spring 169 has one end portion engaged with the spring hook portion 162E, and another end portion engaged with a spring hook portion (not illustrated) of the support plate 102. Hence, the third spring 169 urges the second lever 162 in a clockwise direction in FIG. 16B. That is, the third spring 169 urges the second arm 162C of the second lever 162 in a direction to pivotally move toward the outer peripheral surface of the corresponding sun gear 121 (disc portion 121B) which is one of the components of the planetary gear mechanism. The second arm 162C can prevent the sun gear 121 from rotating upon engagement of the second arm 162C with the pawls 121C of the sun gear 121.

In each lever 160, the tip end portion of the first arm 161C of the first lever 161 is contactable with an outer peripheral surface of the corresponding second cam portion 153. The lever 160 is movable between a transmission position illustrated in FIGS. 16A and 16B and a non-transmission position illustrated in FIGS. 17A and 17B. In the transmission position, the tip end portion of the first lever 161 is apart from the second cam portion 153, and the second lever 162 is engaged with the pawls 121C of the clutch 120, thereby providing the engaging state of the clutch 120. In the non-transmission position, the tip end portion of the first lever 161 comes into contact with the second cam portion 153 and is moved by the second cam portion 153, so that the tip end portion of the second lever 162 is disengaged from the pawls 121C of the sun gear 121 which is one of the components of the planetary gear mechanism, thereby providing the disengaging state of the clutch 120.

Figure 21A:
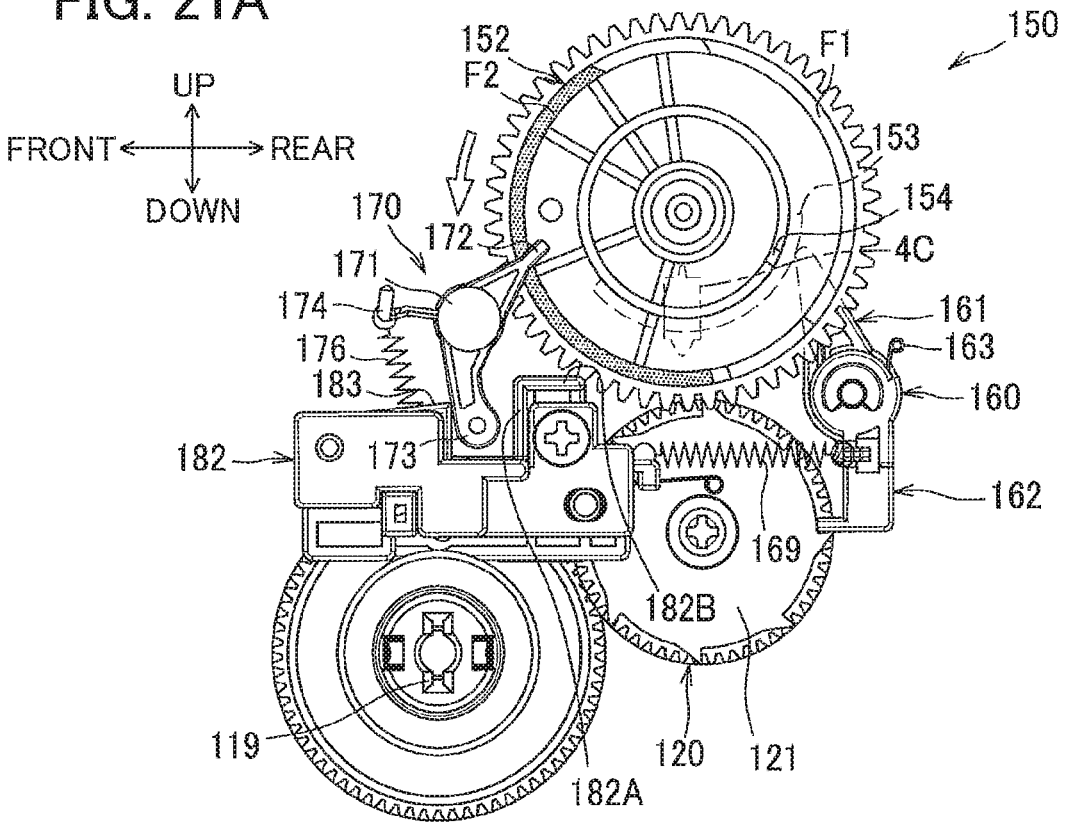
FIG. 21A is a side view illustrating the cam, the cam follower and the release member as viewed in the axial direction in a state where the cam further rotates from the state illustrated in FIG. 20B in the reverse rotating direction, the developing roller is at the separated position, and the first lever is at a pivotally moved position in the image-forming apparatus according to the embodiment.

Further, when the first lever 161 is pressed by the second cam portion 153 as a result of the rotation of the motor 3 in its reverse rotating direction in a state where the lever 160 is at an engagement position where the second lever 162 is engaged with the pawls 121C of the sun gear 121 which is one of the components of the planetary gear mechanism, the first lever 161 is pivotally moved relative to the second lever 162 to the pivotally moved position as illustrated in FIG. 21A against the urging force of the second spring 163. In this way, since the first lever 161 is pivotally movable relative to the second lever 162, application of excessive force to the lever 160 can be obviated while the motor 3 rotates in the reverse rotating direction.

Next, a control operation of the controller 2 will be described.

The controller 2 is configured to control overall operations performed in the image-forming apparatus 1. The controller 2 includes a CPU, a ROM, a RAM, an input/ output portion, and the like. The controller 2 is configured to perform various processes by executing preliminarily stored programs.

In the present embodiment, the controller 2 is configured to control the YMC clutch 140A and the K clutch 140K according to signals transmitted from the separation sensors 4C and 4K, thereby controlling the contact/separation of the developing rollers 61 relative to the photosensitive drums 50.

The controller 2 is configured to permit each of the cams 150 to start rotating in response to closure of the cover 11. Further, the controller 2 is configured to permit, subsequent to the closure of the cover 11, each of the cams 150 to stop rotating after a second detection of the counterpart detection portion by a corresponding one of the separation sensors 4C and 4K and before a third detection of the counterpart detection portion by the corresponding one of the separation sensors 4C and 4K.

Figure 13:
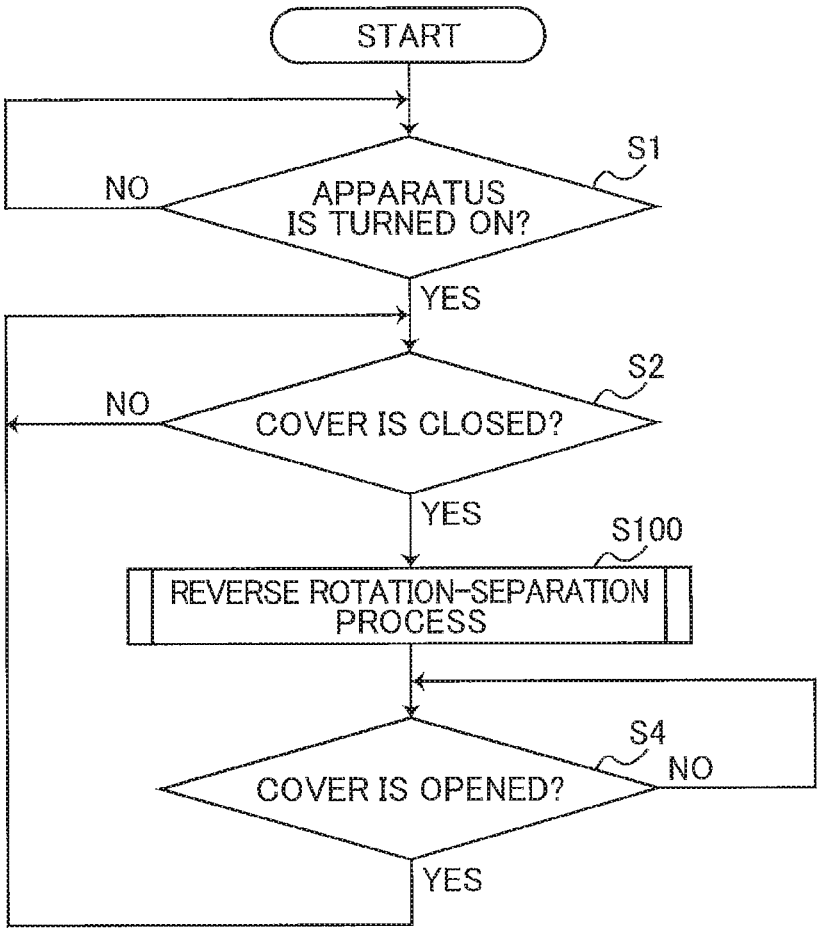
Figure 14:
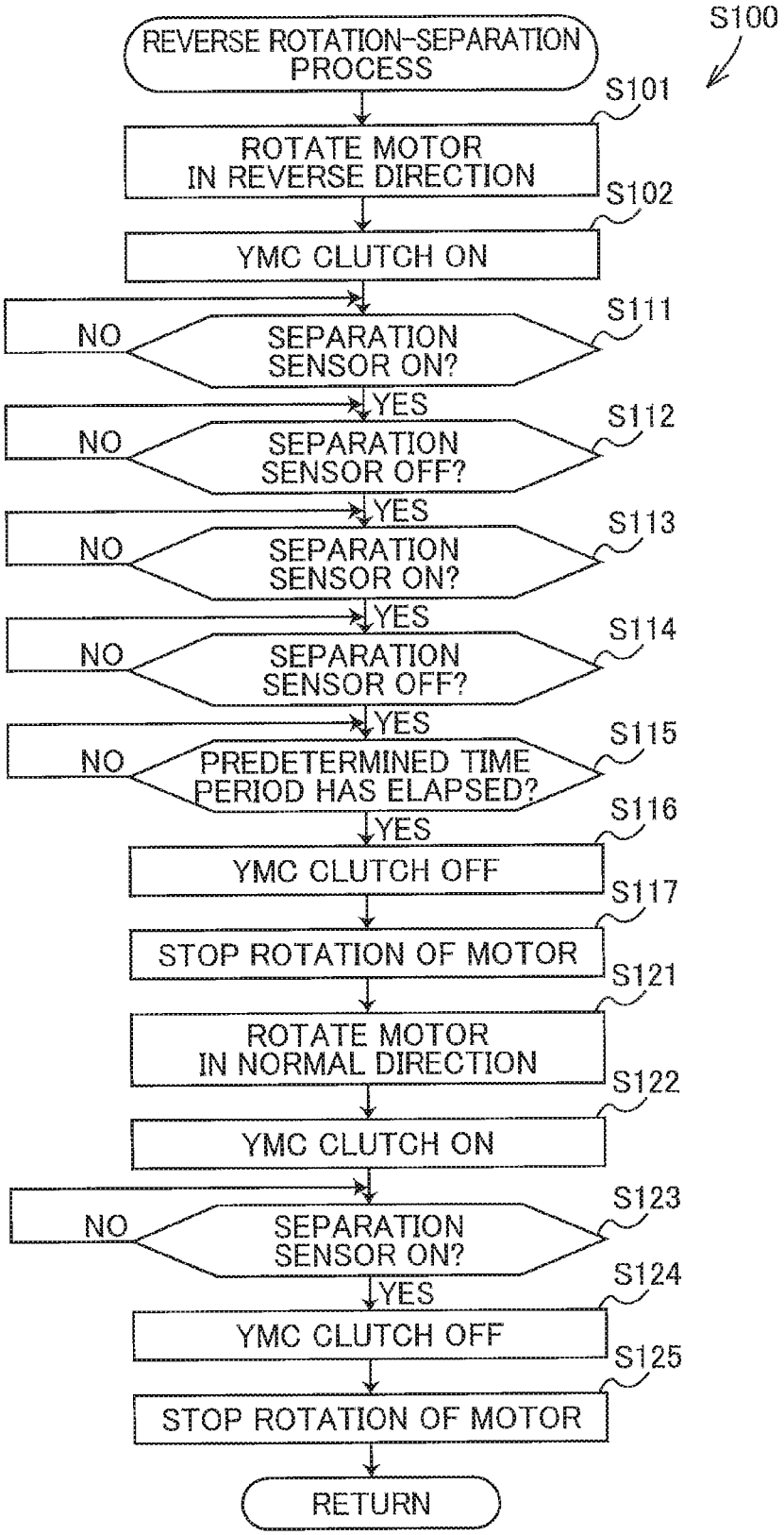
FIG. 14 is a flowchart illustrating steps in a reverse rotation-separation process executed by the controller of the image-forming apparatus according to the embodiment.

To this effect, the controller 2 performs processes as illustrated in FIGS. 13 and 14, for example.

As illustrated in FIG. 13, in S the controller 2 determines whether the image-forming device 1 is turned on. If the image-forming device 1 is turned on (S1: YES), the controller 2 advances to S2. On the other hand, when the image-forming apparatus 1 is not turned on (S1: NO), the controller 2 waits for the image-forming apparatus 1 being turned on.

After the image-forming apparatus 1 is turned on (S1: YES), in S2 the controller 2 determines whether the cover 11 is closed according to a signal transmitted from the unillustrated cover sensor. If the cover 11 is still opened (S2: NO), the controller 2 waits for the cover 11 being closed. If the cover 11 is closed (S2: YES), in S100 the controller 2 permits the cams 150 to rotate in its reverse rotating direction to execute a reverse rotation-separation process for separating each of the developing roller from a corresponding one of the photosensitive drums 50.

Then, in S4 the controller 2 determines whether the cover 11 is opened according to the signal transmitted from the cover sensor. If the cover 11 is closed (S4: NO), the controller 2 waits for the cover 11 being opened. If the cover 11 is opened (S4: YES), the controller 2 returns to S2 to wait for the cover 11 being closed.

Next, the reverse rotation-separation process will be described with reference to FIG. 14. After the cover 11 is closed, the controller 2 performs the reverse rotation-separation process (S100) as illustrated in FIG. 14 so that the cams 150, and the levers 160 and the cam followers 170 those cooperating with the cams 150 are returned to their initial positions.

First, in S101 the controller 2 permits the motor 3 to rotate in the reverse rotating direction, and in S102 the controller 2 then places the YMC clutch 140A into an ON state. Hence, each of the cams 150 (cams 150Y, 150M, and 150C) rotates in its reverse rotating direction (i.e., counterclockwise direction in FIGS. 16A through 17B).

In S111 the controller 2 then determines whether the separation sensor 4C has been turned on (ON state), i.e., whether the separation sensor 4C has outputted the ON signal. If the separation sensor 4C has not been turned on, i.e., the separation sensor 4C has not outputted the ON signal (S111: NO), the controller 2 waits for the separation sensor 4C outputting the ON signal.

When the controller 2 determines that the separation sensor 4C has been turned to the ON state, i.e., the separation sensor 4C has outputted the ON signal (S111: YES), in S112 the controller 2 then determines whether the separation sensor 4C has turned off (OFF state), i.e., whether the signal outputted from the separation sensor 4C has changed from the ON signal to the OFF signal. If the separation sensor 4C has not been turned off, i.e., the signal outputted from the separation sensor 4C has not changed to the OFF signal (S112: NO), the controller 2 waits for the separation sensor 4C outputting the OFF signal.

When the controller 2 determines that the separation sensor 4C has been turned off (S112: YES), in S113 the controller 2 determines whether the separation sensor has been turned on, i.e., whether the signal outputted from the separation sensor 4C has further changed from the OFF signal to the ON signal. If the separation sensor 4C has not been turned on, i.e., the signal outputted from the separation sensor 4C has not changed from the OFF signal to the ON signal (S113: NO), the controller 2 waits for the separation sensor 4C outputting the ON signal.

When the controller 2 determines that the separation sensor 4C has been turned on (S113: YES), in S114 the controller 2 determines whether the separation sensor 4 has been turned off, i.e., the signal outputted from the separation sensor 4C has been changed from the ON signal to the OFF signal. If the separation sensor 4C has not been turned off (S114: NO), the controller 2 waits for the separation sensor 4C outputting the OFF signal.

After the controller 2 determines that the separation sensor 4C has been turned off (S114: YES), in S115 the controller 2 determines whether a predetermined time period has elapsed. If the predetermined time period has not been elapsed (S115: NO), the controller 2 repeats the determination in S115.

When the controller 2 determines that the predetermined time period has elapsed after the affirmative determination made in S114 (S115: YES), in S116 the controller 2 places the YMC clutch 140A into an OFF state, and in S117 the controller 2 permits the motor 3 to stop rotating. Upon placing the YMC clutch 140A into the OFF state in S116, the cams 150 (cams 150Y, 150M, and 150C) stop rotating.

That is, by way of steps S111 through S114, the state of the separation sensor 4C is changed from the ON state through the OFF state and the ON state and to the OFF state. In other words, rotation of the cams 150 (cams 150Y, 150M, and 150C) is stopped upon elapse of the predetermined time period after the separation sensor 4C is turned on twice and is finally turned off.

In S121 the controller 2 then permits the motor 3 to rotate in the normal rotating direction, and in S122 the controller 2 places the YMC clutch 140A to its ON state. Hence, each of the cams 150 (cams 150Y, 150M, and 150C) rotates in the normal rotating direction.

In S123 the controller 2 determines whether the separation sensor 4C has been turned on, i.e., whether the signal outputted from the separation sensor 4C has changed from the OFF signal to the ON signal. If the separation sensor 4C has not been turned on i.e., the signal outputted from the separation sensor 4C has not been changed to the ON signal (S123: NO), the controller 2 waits for the separation sensor 4C outputting the ON signal.

When the controller 2 determines that the separation sensor 4C has been turned on (S123: YES), in S124 the controller 2 places the YMC clutch 14A into its OFF state, and in S125 the controller 2 permits the motor 3 to stop rotating. Upon placing the YMC clutch 140A into the OFF state, the cams 150 (cams 150Y, 150M, and 150C) stops rotating.

The process for returning each of the cams 150Y, 150M, and 150C for the color of yellow, magenta, and cyan to its initial position has been described above. However, although detailed description will be omitted with respect to the color of black, similar process can be performed for returning the cam 150K to its initial position only by using the separation sensor 4K instead of the separation sensor 4C and using the K clutch 140K instead of the YMC clutch 140A.

Next, an operation of each component in the image-forming apparatus 1 performing the above-described process will be described with reference to FIGS. 15 through 23.

When the cover 11 is at the closed position and the image-forming apparatus 1 performs a normal operation, the following two situations are likely to occur. The first situation is that the contact portion 172 of each of the cam followers 170 is positioned on the first holding surface F1 of the corresponding first cam portion 152 as illustrated in FIGS. 16A and 16B (each developing roller 61 is at the contact positions). The second situation is that the contact portion 172 of each of the cam followers 170 is positioned on the second holding surface F2 of the corresponding first cam portion 152 as illustrated in FIGS. 17A and 17B (each developing roller 61 is at the separated position).

In any of the situations, in a case where the cam 150 rotates in the normal rotating direction (clockwise direction in FIGS. 16A through 17B) in accordance with the rotation of the motor 3 in the normal rotating direction, the contact portion 172 is urged upward by the frictional force generating between the contact portion 172 and the first cam portion 152, so that the cam follower 170 is urged in the counterclockwise direction. Hence, the posture of the cam follower 170 is fixed by the abutment of the arm 174 on the release engagement portion 182A.

Figure 17A:
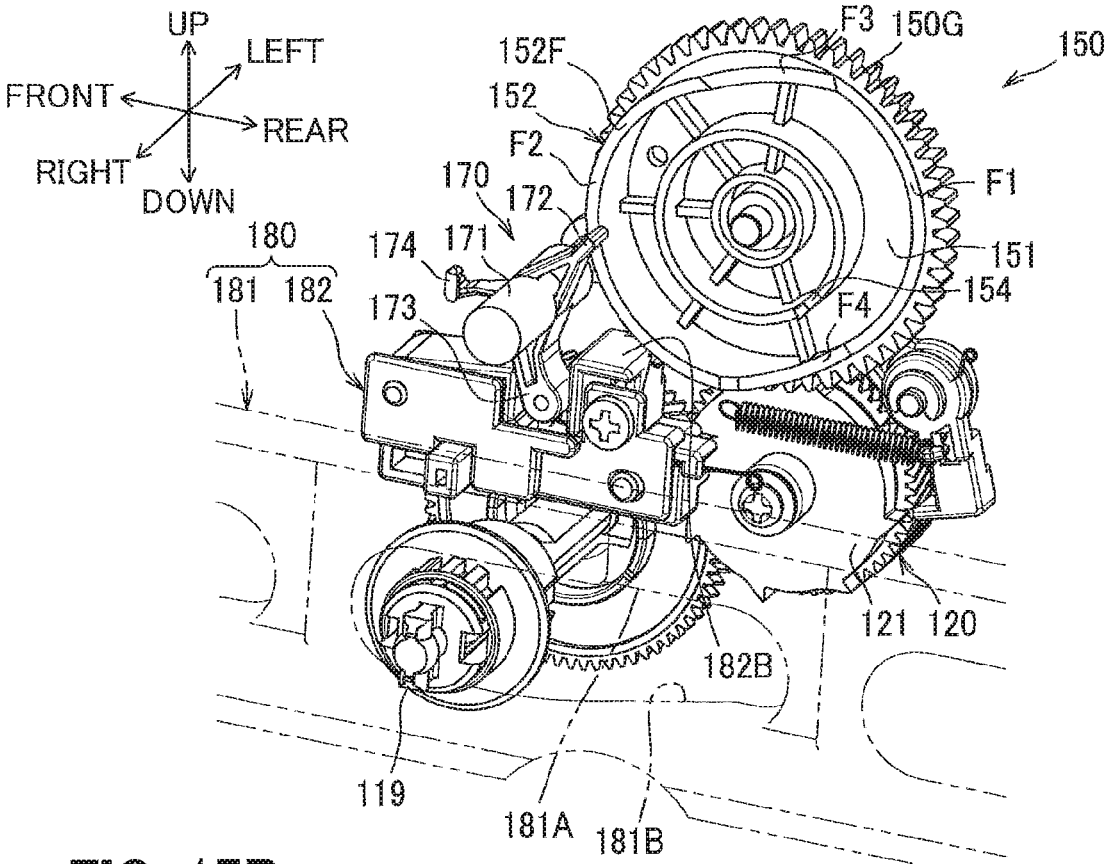
FIG. 17A is a perspective view illustrating the cam, the cam follower and the release member in a state where the cam rotates from the state illustrated in FIG. 16A in the normal rotating direction and the developing roller is at a separated position in the image-forming apparatus according to the embodiment.
Figure 17B:
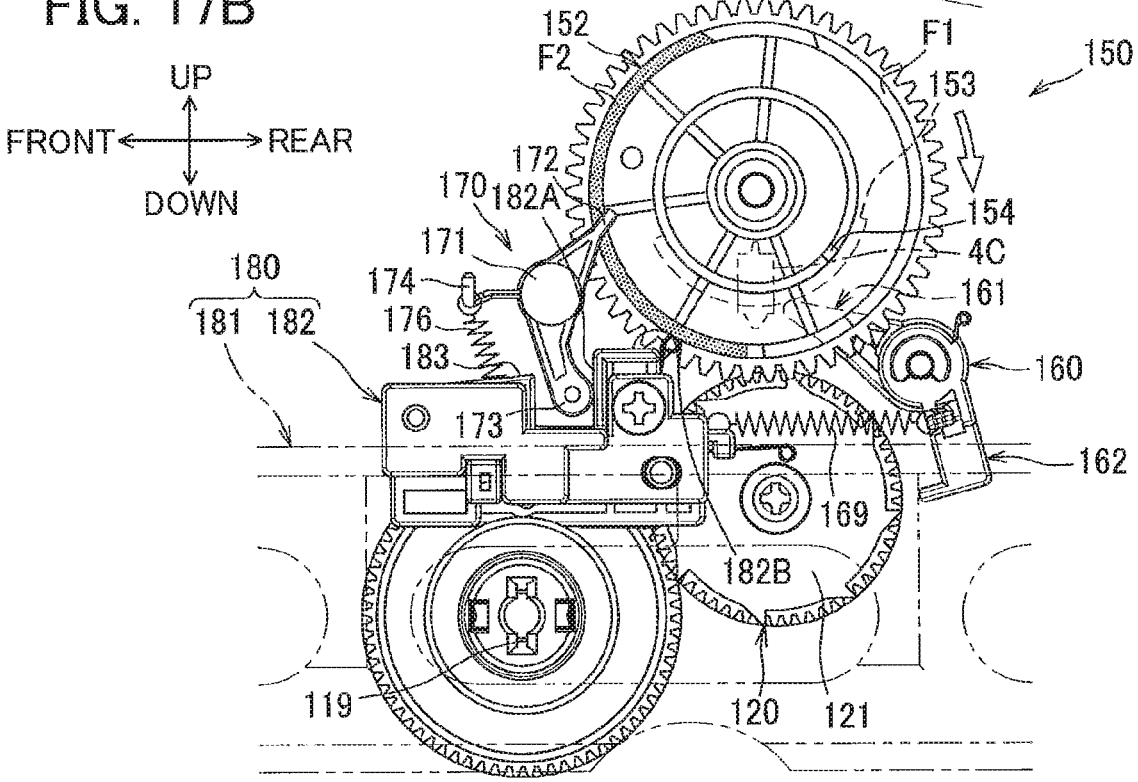
FIG. 17B is a side view illustrating the cam, the cam follower and the release member as viewed in the axial direction in a state where the cam rotates from the state illustrated in FIG. 16B in the normal rotating direction and the developing roller is at the separated position in the image-forming apparatus according to the embodiment.
Figure 18A:
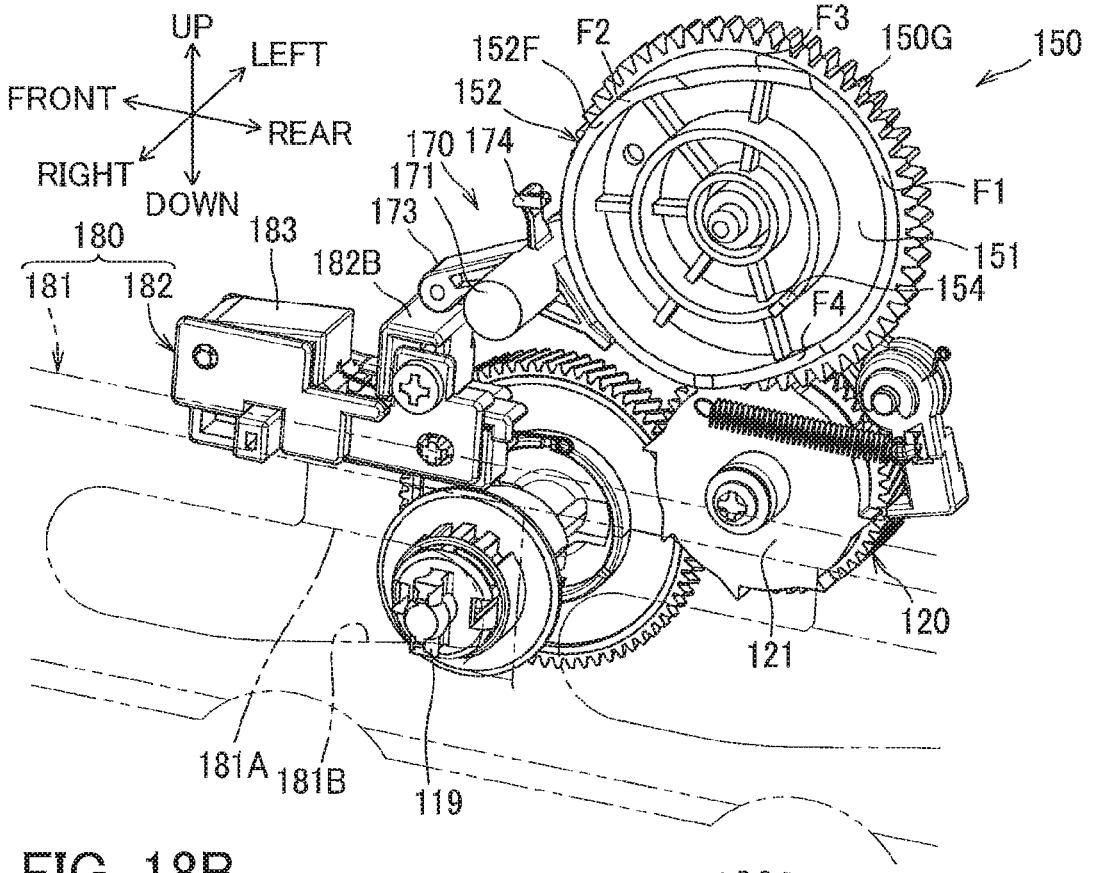
FIG. 18A is a perspective view illustrating the cam, the cam follower and the release member in a state where the cover is at the open position in the image-forming apparatus according to the embodiment.
Figure 18B:
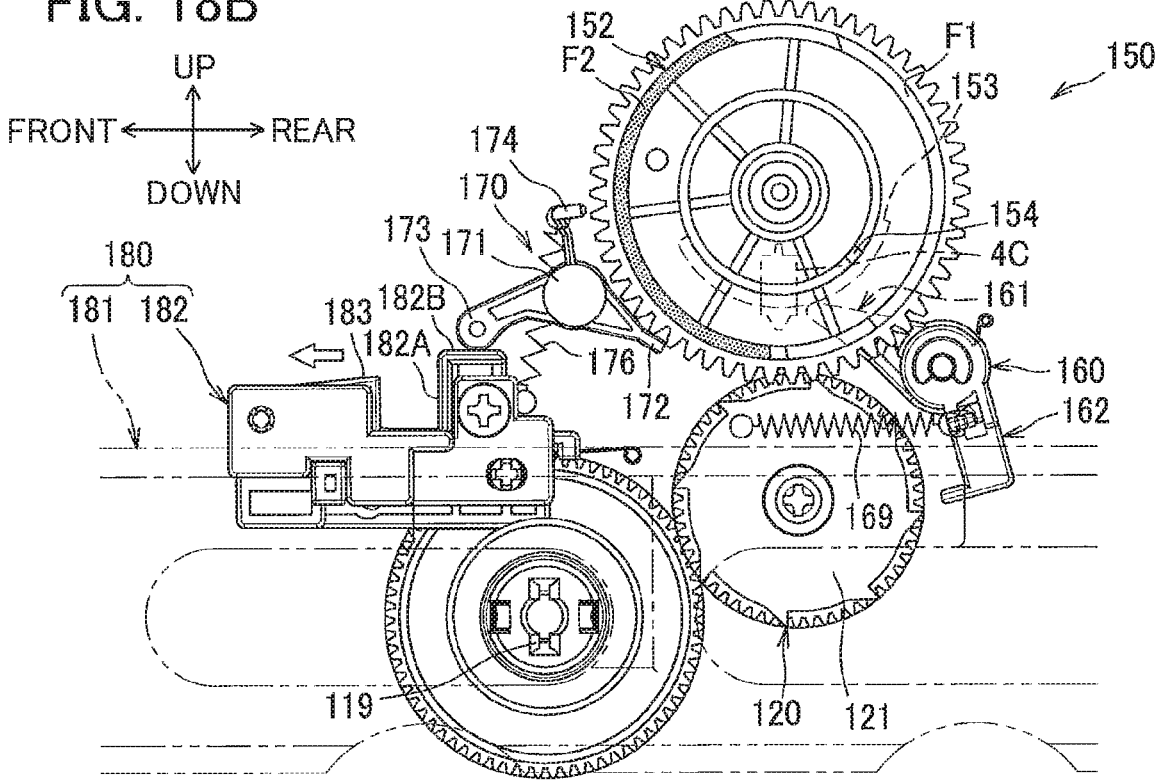
FIG. 18B is a side view illustrating the cam, the cam follower and the release member as viewed in the axial direction in a state where the cover is at the open position in the image-forming apparatus according to the embodiment.

As illustrated in FIGS. 18A and 18B, the release member 180 is pulled by the cover 11 to linearly move frontward in accordance with the movement of the cover 11 from the closed position to the open position in a state where the contact portion 172 is positioned on the second holding surface F2 as illustrated in FIGS. 17A and 17B and the developing roller 61 is at the separated position. Hence, the coupling shaft 119 is pushed by the coupling retraction cam 181B of the release member 180 in the axial direction (leftward) to be disengaged from the coupling 65.

Further, in accordance with the frontward linear movement of the release member 180, the release engagement portion 182A urges the arm 173 of the cam follower 170 frontward to pivotally move the cam follower 170 from the operating position to the non-operating position. Further, the arm 173 is seated on the cam follower holding portion 182B, whereupon a posture of the cam follower 170 is maintained. Therefore, the cam follower 170 can maintain its non-operating position regardless of the angular rotational position of the cam 150 as long as the cam follower holding portion 182B holds the posture of the cam follower 170 in the open state of the cover 11.

By the pivotal movement of the cam follower 170 from the operating position to the non-operating position, the cam follower 170 moves from the protruding position to the standby position upon separation of the contact portion 172 from the first cam portion 152 since the first spring 176 urges the cam follower 170 toward the standby position. Hence, the developing roller 61 moves from the separated position to the contact position. When the cam follower 170 is at the standby position, the slide shaft portion 171 is positioned outside of the second opening 91A. Therefore, mechanical interference between the slide shaft portion 171 and the side frame 91L of the drawer 90 does not occur while the drawer 90 is pulled out of the housing 10 or is inserted into the housing 10 through the first opening 10A.

Figure 15:
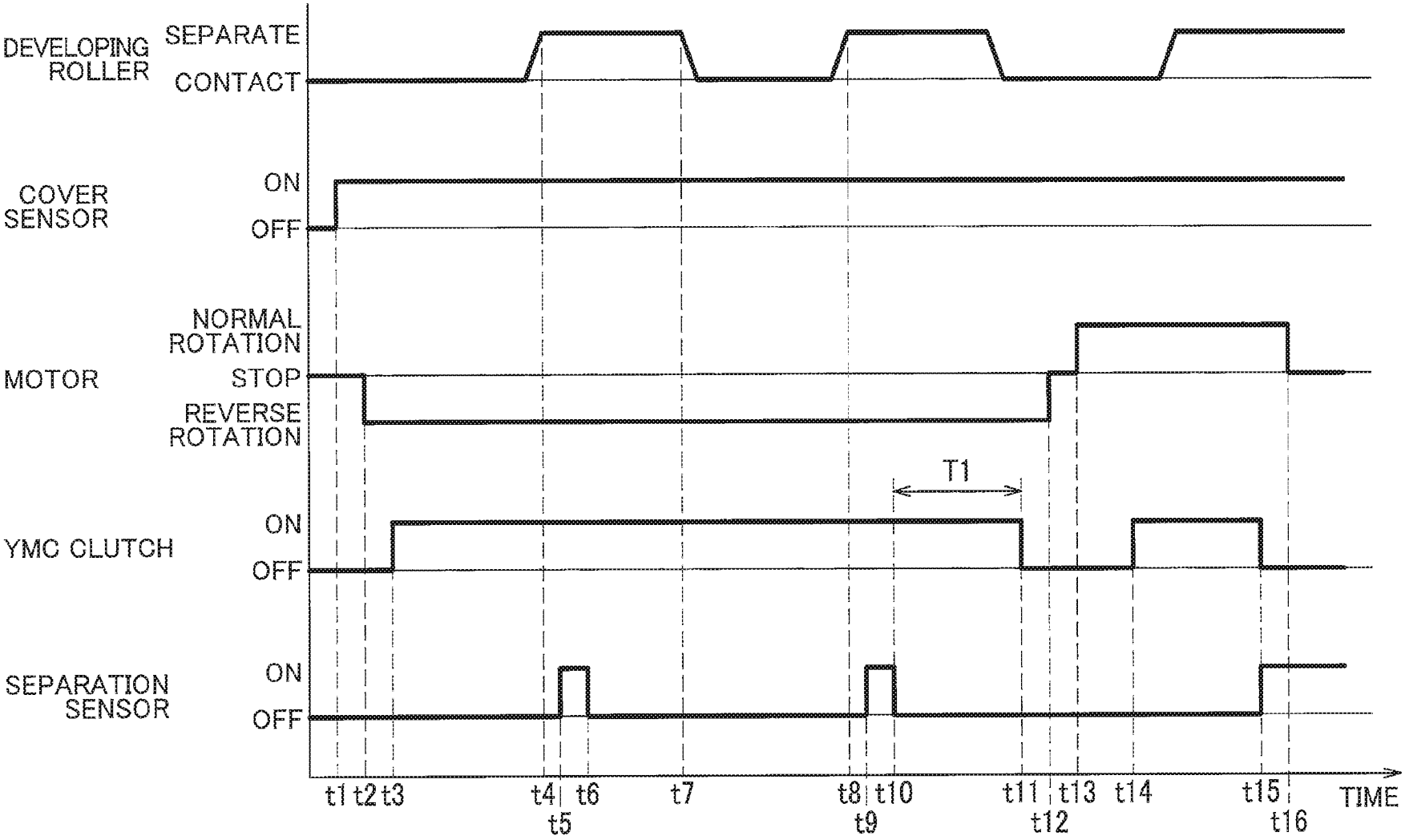
Figure 19A:
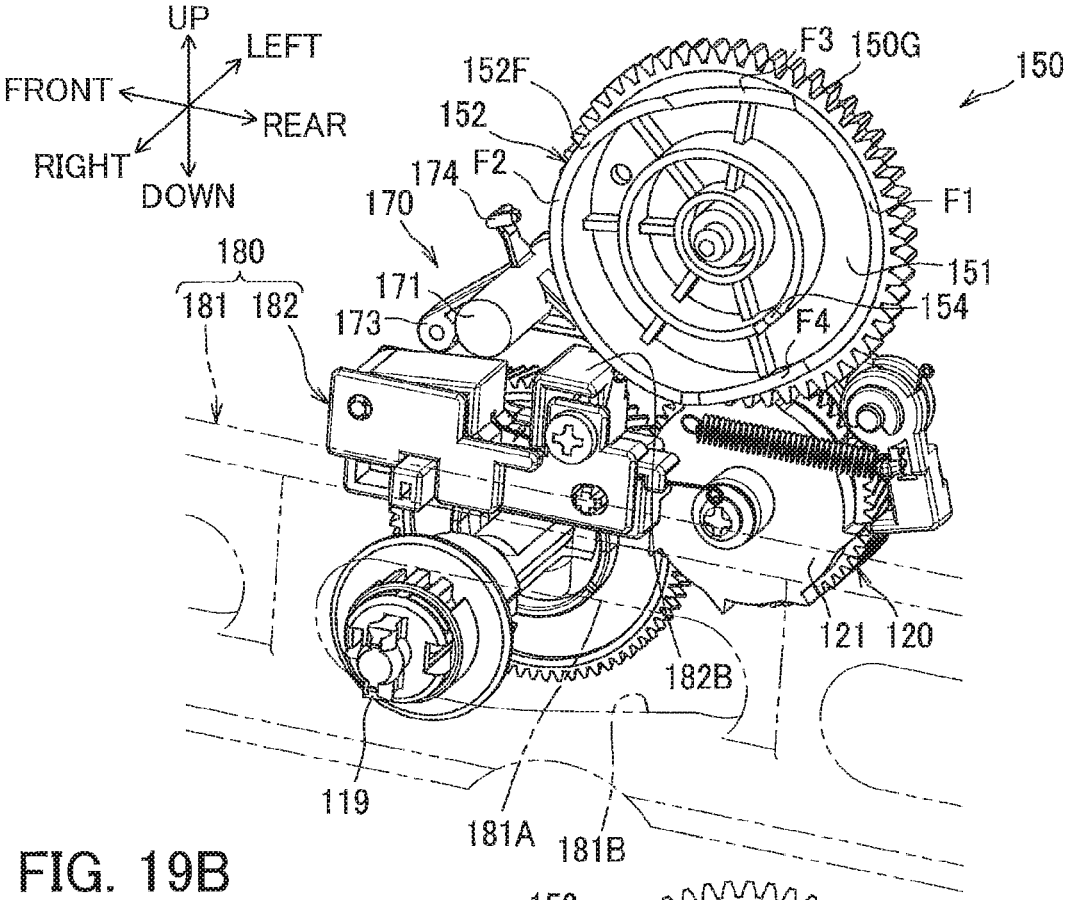
FIG. 19A is a perspective view illustrating the cam, the cam follower and the release member in a state where the cover is moved from the open position to the closed position from the state illustrated in FIG. 18A in the image-forming apparatus according to the embodiment.
Figure 19B:
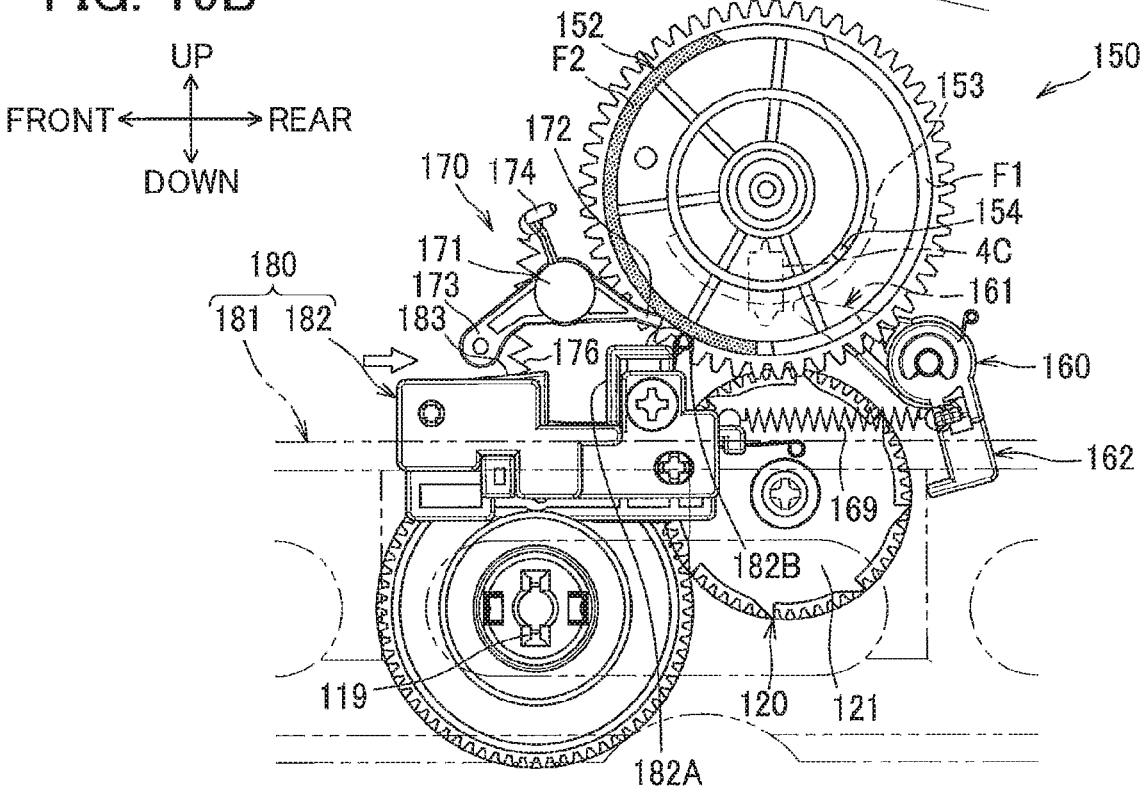
FIG. 19B is a side view illustrating the cam, the cam follower and the release member as viewed in the axial direction in a state where the cover is moved from the open position to the closed position from the state illustrated in FIG. 18B in the image-forming apparatus according to the embodiment.

Then, when the cover 11 moves from the open position to the closed position, the cover sensor (not illustrated) is turned on at the timing t1 in FIG. 15, and the release member 180 is linearly moved rearward as illustrated in FIGS. 19A and 19B. Hence, the coupling shaft 119 moves in a protruding direction (rightward) to engage the coupling 65. Further, by the linear rearward movement of the release member 180, the arm 173 of the cam follower 170 is displaced from and disengaged from the upper surface of the cam follower holding portion 182B. However, the cam follower 170 is still maintained at the non-operating position since the contact portion 172 is in contact with the outer peripheral surface of the first cam portion 152. At this time, the lower end of the arm 173 is positioned above the upper surface of the stopper 183. Thus, the stopper 183 can pass below the arm 173 to move rearward without mechanical interference with the arm 173.

Incidentally, when the cover 11 moves from the closed position to the open position and then moves back to the closed position in a state where the developing roller 61 is at its contact position and the contact portion 172 is positioned on the second holding surface F2 while the cover 11 is at the closed position, the cam follower 170 is pivotally moved by the urging force of the first spring 176 so that the contact portion 172 can be moved to the position contactable with the first cam 152 (see FIGS. 16A and 16B). That is, the cam follower 170 is pivotally moved from the non-operating position to the operating position when the cover 11 moves from the open position to the closed position.

After the cover 11 is positioned at the closed position, the controller 2 permits the motor 3 to rotate in the reverse rotating direction at the timing t2, and places the YMC clutch 140A into its ON state at the timing 3. Hence, the cam 150 rotates in the reverse rotating direction.

Figure 20A:
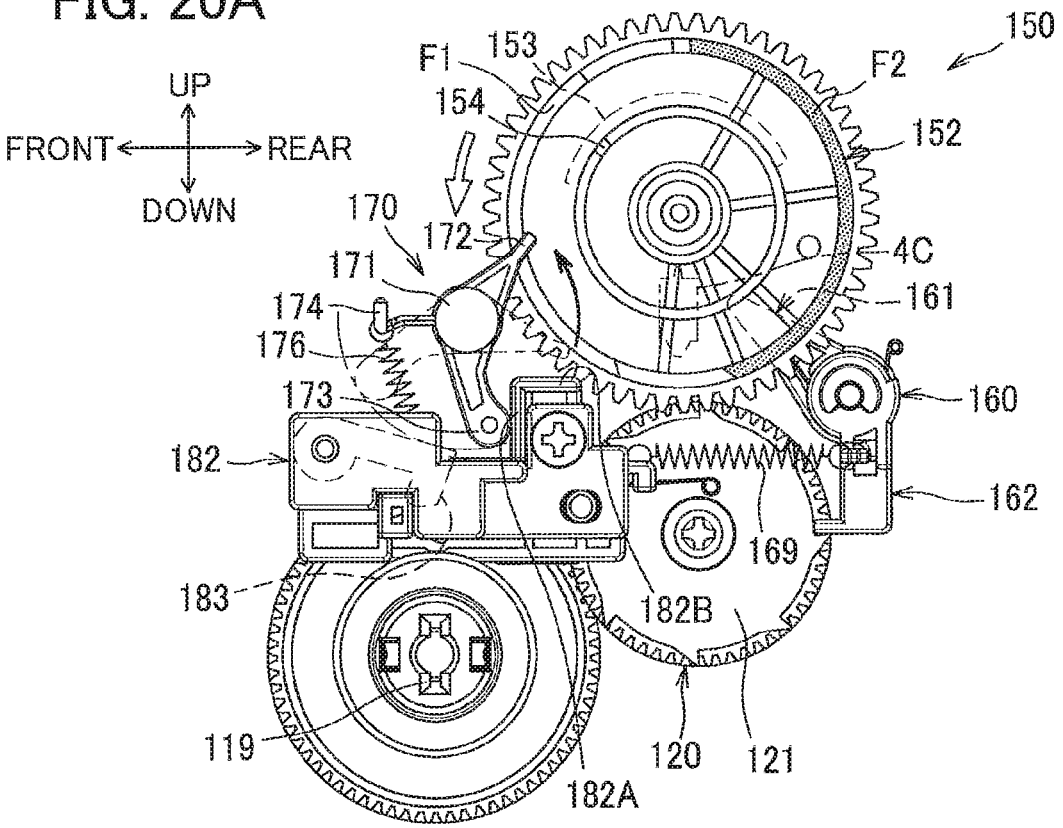
FIG. 20A is a side view illustrating the cam, the cam follower and the release member as viewed in the axial direction in a state where the cam rotates from the state illustrated in FIG. 19B in a reverse rotating direction and the cam follower moves from a non-operating position to an operating position in the image-forming apparatus according to the embodiment.
Figure 20B:
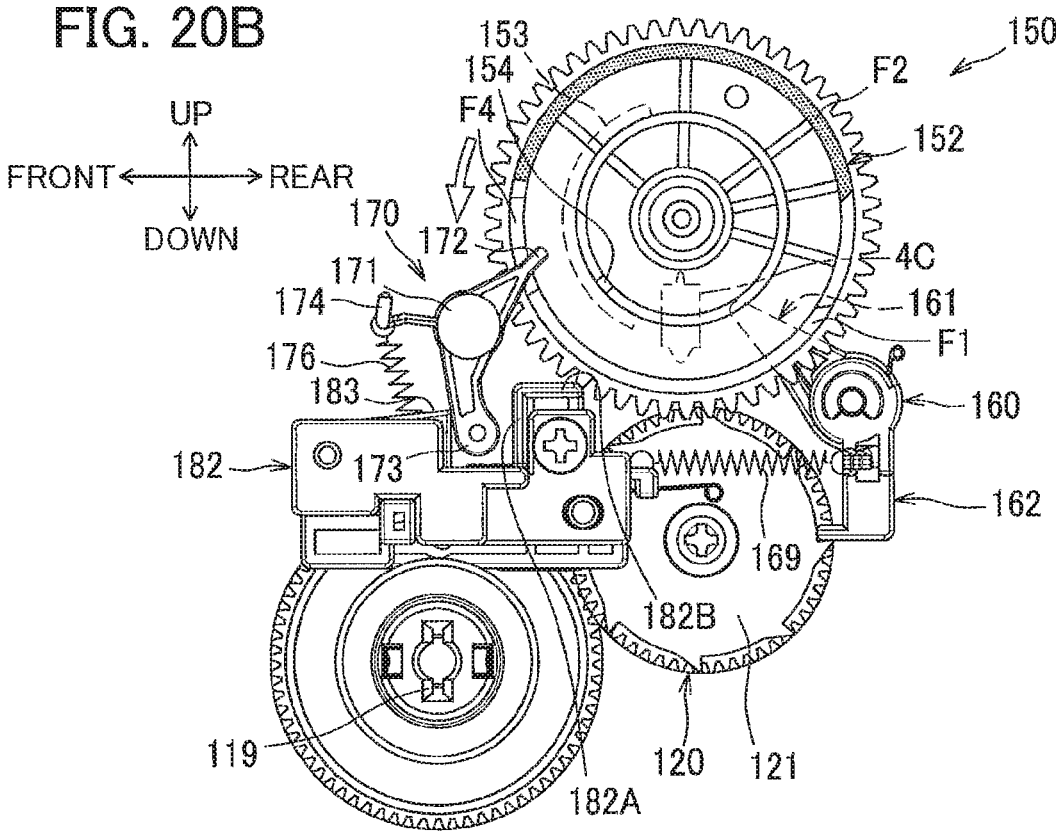
FIG. 20B is a side view illustrating the cam, the cam follower and the release member as viewed in the axial direction in a state where the cam further rotates from the state illustrated in FIG. 20A in the reverse rotating direction and the stopper prevents the cam follower from pivotally moving in the image-forming apparatus according to the embodiment.

When the cam 150 rotates in the reverse rotating direction as illustrated in FIG. 20A from the state where the contact portion 172 is in abutment with the outer peripheral surface of the first cam portion 152 as illustrated in FIGS. 19A and 19B, the cam follower 170 is pivotally moved in the counterclockwise direction in FIGS. 20A and 20B from the non-operating position to the operating position by the urging force of the first spring 176 upon separation of the contact portion from the outer peripheral surface of the first cam portion 152. In this case, the stopper 183 is pressed by the arm 173 of the cam follower 170 to pivotally move downward once.

Then, as illustrated in FIG. 20B, upon abutment of the first cam portion 172 with the second guide surface F4 of the first cam portion 152 by the further rotation of the cam 150 in the reverse rotating direction, the contact portion 172 is urged downward by the frictional force between the second guide surface F4 and the contact portion 172, and hence, the cam follower 170 pivotally moves slightly in the clockwise direction in FIG. 20B. Then the posture of the cam follower 170 is fixed by the abutment of the arm 173 with the stopper 183. Thereafter, the cam follower 170 is moved, without its pivotal movement, to the protruding position by the pressing force from the second guide surface F4.

Then, upon further rotation of the cam 150 in the reverse rotating direction from the state illustrated in FIG. 20B, the contact portion 172 is positioned on the second holding surface F2 as illustrated in FIG. 21A, and hence, the slide shaft portion 171 is positioned at the protruding position. Thus, the developing roller 61 is positioned at its separated position at the timing t4. Then, upon the counterpart detection portion 154 moving past the separation sensor 4C, the signal outputted from the separation sensor 4C is changed to the ON signal at the timing t5, and then is changed to the OFF signal at the timing t6.

Then, the first lever 161 of the lever 161 comes into contact with the second cam portion 153. At this time, the second lever 162 cannot be moved, since the second lever 162 is engaged with the sun gear 121. Instead, the first lever 161 is pivotally moved to the pivotally moved position against the urging force of the second spring 163.

Figure 21B:
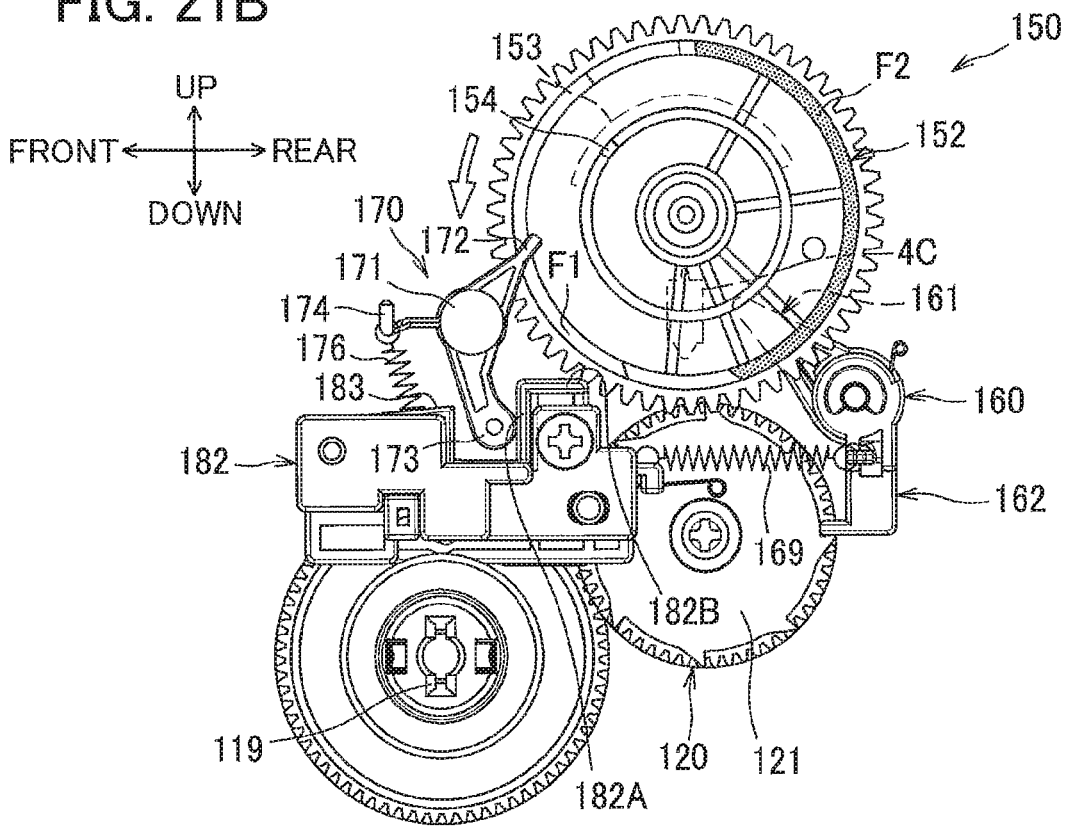
FIG. 21B is a side view illustrating the cam, the cam follower and the release member as viewed in the axial direction in a state where the cam further rotates from the state illustrated in FIG. 21A in the reverse rotating direction and the developing roller is at the contact position in the image-forming apparatus according to the embodiment.

Upon further rotation of the cam 150 in the reverse rotating direction from the state illustrated in FIG. 21A, the contact portion 172 is positioned on the first holding surface F1 as illustrated in FIG. 21B, and hence, the slide shaft portion 171 is positioned at the standby position. Thus, the developing roller 61 is positioned at the contacting position at the timing t7.

Figure 22A:
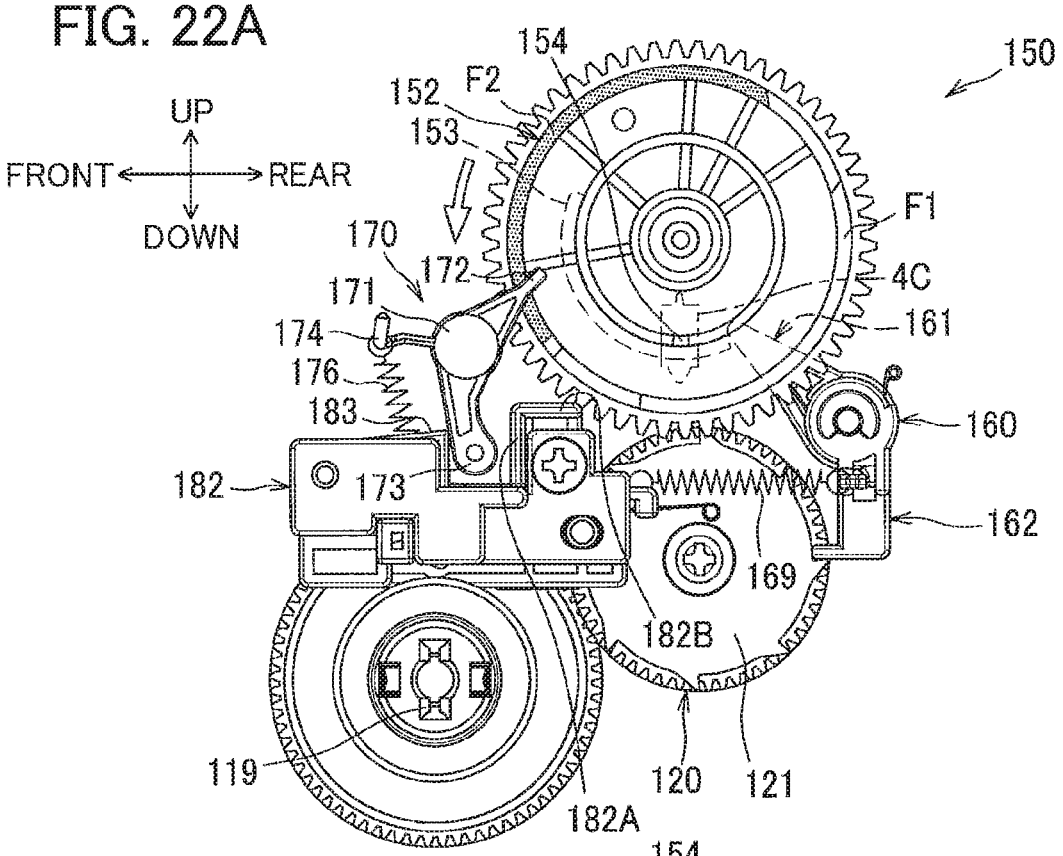
FIG. 22A is a side view illustrating the cam, the cam follower and the release member as viewed in the axial direction in a state where the cam further rotates from the state illustrated in FIG. 21B in the reverse rotating direction, a contact portion is in contact with a first cam portion, and the stopper prevents the arm from pivotally moving in the image-forming apparatus according to the embodiment.

Then, as illustrated in FIG. 22A, the cam 150 further rotates in the reverse rotating direction until the contact portion 172 is again positioned on the second holding surface F2 to move the developing roller 61 away from the photosensitive drum 50 at the timing t8. Subsequently, the counterpart detection portion 154 reaches the separation sensor 4C, and the signal outputted from the separation sensor 4C is changed to the ON signal at the timing t9. This detection of the counterpart detection portion 154 by the separation sensor 4C is the second time after the start of the rotation of the cam 150 in the reverse rotating direction.

Figure 22B:
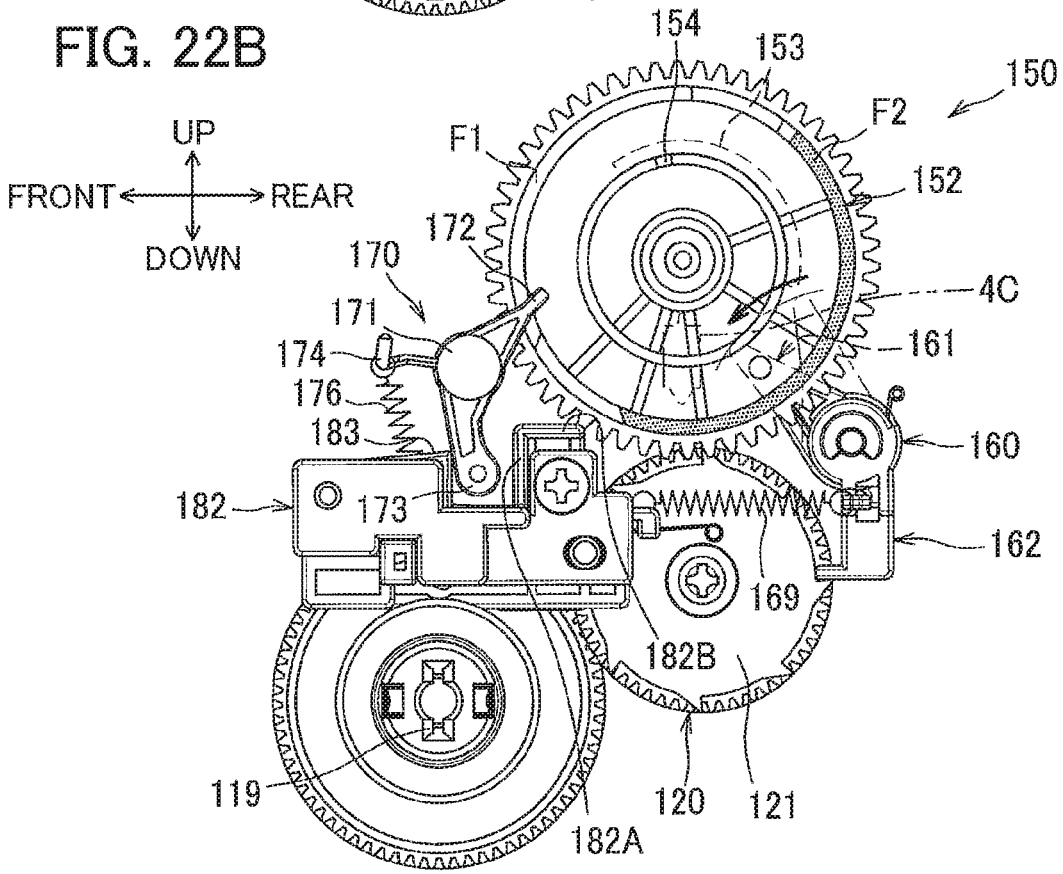
FIG. 22B is a side view illustrating the cam, the cam follower and the release member as viewed in the axial direction in a state where a counterpart detection portion moves past the separation sensor and the cam stops rotating after the separation sensor detects the counterpart detecting portion twice in the image-forming apparatus according to the embodiment.

Then, upon elapse of the predetermined time period T1 from the timing t10 at which the signal outputted from the separation sensor 4C has been changed to the OFF signal by the further rotation of the cam 150 in the reverse rotating direction, the controller 2 places the YMC clutch 140A into the OFF state at the timing t11, and permits the motor 3 to stop rotating at the timing t12. Thus, the rotation of the cam 150 is stopped as illustrated in FIG. 22B. At this time, the first lever 161 of the lever 160 is out of contact with the second cam portion 153, and pivotally moves from the pivotally moved position to the ordinary position. That is, the predetermined time period T1 is set so as to provide such timed relation.

Subsequently, the controller 2 permits the motor 3 to rotate in the normal rotating direction at the timing t13, and places the YMC clutch 140A into the ON state at the timing t14 to thus rotate the cam 150 in the normal rotating direction. Then, after the cam 150 rotates a predetermined angle in the normal rotating direction, the counterpart detection portion 154 reaches the separation sensor 4C and the signal outputted from the separation sensor 4C is changed to the ON signal at the timing t15. The controller 2 places the YMC clutch 140A into the OFF state at this timing t15. Thereafter, the controller 2 permits the motor 3 to stop rotating at the timing t16.

Figure 23:
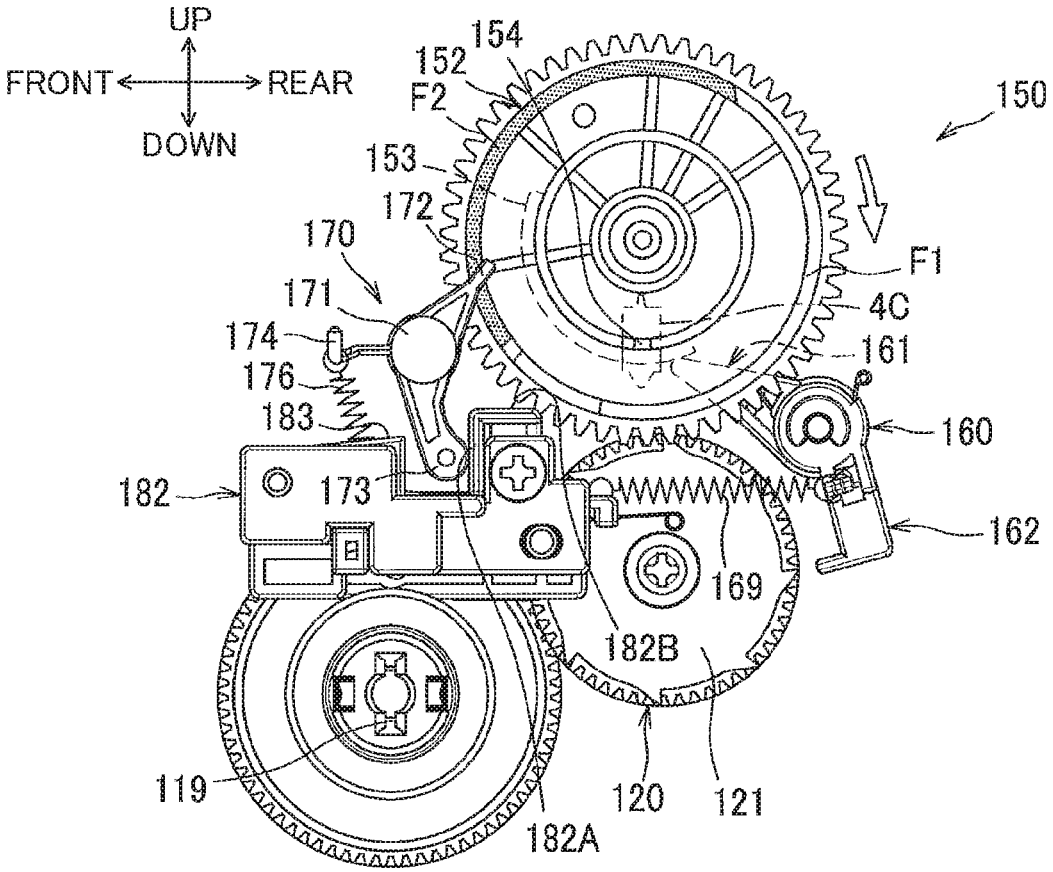
FIG. 23 is a side view illustrating the cam, the cam follower and the release member as viewed in the axial direction in a state where the cam rotates from the state illustrated in FIG. 22B in the normal rotating direction, the separation sensor detects the counterpart detection portion, and the cam stop rotating.

Accordingly, as illustrated in FIG. 23, the contact portion 172 is positioned on the second holding surface F2 to position the slide shaft portion 171 at the protruding position, and hence, the developing roller 61 is at the separated position. Further, in the lever 160, the first lever 161 is pressed by the second cam portion 153 to be at the non-operating position providing the cut-off state of the clutch 120. In this way, the image-forming apparatus 1 can be placed into its initial state in which each developing roller 61 is apart from the corresponding photosensitive drum 50 in a case where the cover 11 is moved back to the closed position after the movement of the cover 11 from the closed position to the open position.

According to the above-described embodiment, upon movement of the cover 11 from the closed position to the open position, each release engagement portion 182A comes into contact with the arm 173 of the corresponding cam follower 170 to pivotally move the cam follower 170 to the non-operating position. The contact portion 172 is not guided by the first cam portion 152 in a case where the cam follower 170 is at the non-operating position. Therefore, the cam follower 170 is maintained at the standby position independently of the rotation of the cam 150. Accordingly, mechanical interference of each cam follower 170 with the side frame 91L of the drawer 90 can be obviated since the cam 150 is at its standby position when the cover 11 is opened.

Further, according to the above-described embodiment, the single first spring 176 urges the cam follower 170 from the protruding position toward the standby position, and urges the cam follower 170 from the non-operating position toward the operating position. Therefore, the number of components can be reduced.

Further, according to the above-described embodiment, the controller 2 can move each cam 150 back to its initial position under the simple control using the number of detection times of the counterpart detection portions 154 by the separation sensors 4C and 4K.

Further, according to the above-described embodiment, the stopper 183 is pivotally moved by the pressing force from the arm 173 to allow the cam follower 170 to pivotally move from the non-operating position toward the operating position, even if the cam follower 170 is positioned at the non-operating position when the cover 11 moves from the open position to the closed position. Hence, the cam follower 170 can be returned to the operating position.

Further, according to the above-described embodiment, the lever 160 is provided by the combination of the first lever 161 and the second lever 162, and the first lever 161 is pivotally movable relative to the second lever 162. Therefore, application of excessive force to the lever 160 can be avoided in a case where the motor 3 rotates in its reverse rotating direction.

While the description has been made in detail with reference to the embodiments, it would be apparent to those skilled in the art that many modifications and variations may be made thereto.

For example, each of the second openings 91A formed in the left side frame 91L is in the form of the recess or notch whose upper end is open. However, each second opening may be a through-hole extending throughout the thickness of the side frame.

Further, according to the above-described embodiment, the image-forming apparatus 1 is a color printer using toners of the four colors. However, the image-forming apparatus of the disclosure may be a color printer employing toners of three colors or five colors for forming color images. As a further modification, the image-forming apparatus may be a monochromatic printer employing a toner of a single color.

Still alternatively, a multifunction peripheral and a copying machine are also available as the image-forming apparatus of the disclosure.

What is claimed is:

1. An image-forming apparatus comprising:

a housing having a first opening;

a cover movable between a closed position closing the first opening and an open position opening the first opening;

a drawer comprising:

a photosensitive drum; and a side wall configured to support the photosensitive drum and having a second opening;

a developing cartridge attachable to and detachable from the drawer, the developing cartridge comprising a developing roller movable between a contact position in contact with the photosensitive drum and a separated position away from the photosensitive drum; and a separation mechanism configured to move the developing roller between the contact position and the separated position, the separation mechanism comprising:

a cam;

a cam follower slidably movable along an axis between a standby position and a protruding position protruding toward the developing cartridge, the cam follower being pivotally movable about the axis between an operating position and a non-operating position; and a release member movable in accordance with movement of the cover between the open position and the closed position, the release member being configured to move the cam follower from the operating position to the non-operating position in accordance with movement of the cover from the closed position to the open position, wherein in a state where the cam follower is at the operating position, the cam follower is guided by the cam in accordance with rotation of the cam to allow the cam follower to slidably move between the protruding position and the standby position:

in a state where the cam follower is at the protruding position, the cam follower is positioned in the second opening to press the developing cartridge to position the developing roller at the separated position; and in a state where the cam follower is at the standby position, the cam follower is positioned out of the second opening to position the developing roller at the contact position, and wherein in a state where the cam follower is at the non-operating position, the cam follower is not guided by the cam to allow the cam follower to be maintained at the standby position independently of the rotation of the cam.

2. The image-forming apparatus according to claim 1, wherein the separation mechanism further comprises a first spring configured to urge the cam follower from the protruding position toward the standby position and from the non-operating position toward the operating position.

3. The image-forming apparatus according to claim 2, further comprising:

a sensor, and a controller, wherein the cam comprises a counterpart detection portion configured to be detected by the sensor, and wherein the controller is configured to control the cam to start rotating in response to the cover moving from the open position to the closed position, and subsequently control the can to stop rotating after the sensor detects the counterpart detection portion twice and before the sensor detects the counterpart detection portion thrice.

4. The image-forming apparatus according to claim 3, further comprising a motor configured to drive the developing roller, wherein the cam further comprises: a first cam configured to move the cam follower; and a second cam rotatable together with the first cam, and wherein the separation mechanism further comprises:

a clutch configured to switch a power transmission status between an engaging state in which the clutch engages transmission of driving force from the motor to the developing roller and a disengaging state in which the clutch disengages the transmission of the driving force from the motor to the developing roller; and a lever pivotally movable by being guided by the second cam, the lever being configured to switch the power transmission status of the clutch between the engaging state and the disengaging state.

5. The image-forming apparatus according to claim 4, wherein in a case where the motor rotates in a normal rotating direction to allow the first cam to guide the can follower in a state where the cover is at the closed position, the release member is in contact with the cam follower to prevent the cam follower from pivotally moving between the operating position and the non-operating position.

6. The image-forming apparatus according to claim 5, further comprising a stopper linearly movable in accordance with linear movement of the release member and pivotally movable relative to the release member between a first position and a second position, wherein in a case where the cover moves from the open position to the closed position while the cam follower is at the operating position, the stopper moves in accordance with the movement of the release member to position the cam follower between the release member and the stopper positioned at the first position, and comes into contact with the cam follower to prevent the cam follower from pivotally moving to the non-operating position in case of rotation of the motor in a reverse rotating direction opposite to the normal rotating direction, and wherein in a case where the cover moves from the open position to the closed position while the cam follower is at the non-operating position, the cam follower pivotally moves toward the operating position by urging force of the first spring, and the cam follower presses the stopper to pivotally move to the second position to allow the cam follower to further pivotally move to the operating position by the urging force of the first spring.

7. The image-forming apparatus according to claim 4, wherein the clutch comprises a planetary gear mechanism, and wherein the lever is pivotally movable between a transmission position at which the lever is engaged with one component of the planetary gear mechanism to place the clutch into the engaging state and a non-transmission position at which the lever is disengaged from the one component of the planetary gear mechanism to place the clutch into the disengaging state.

8. The image-forming apparatus according to claim 7, wherein the lever comprises:

a first lever pivotally movable about a pivot axis and contactable with the second cam;

a second lever pivotally movable about the pivot axis and engageable with the one component of the planetary gear mechanism, the second lever being provided with a stop portion configured to restrict pivotal movement of the second lever in one direction relative to the first lever; and a second spring configured to urge the first lever in a direction opposite to the one direction, wherein the image-forming apparatus further comprises a third spring configured to urge the second lever in a direction to pivotally move toward the one component of the planetary gear mechanism, and wherein when the motor rotates in the reverse rotating direction to cause the second cam to press the first lever in a state where the second lever is engaged with the one component of the planetary gear mechanism, the first lever pivotally moves relative to the second lever against urging force of the second spring.

9. An image-forming apparatus comprising:

a housing having a first opening;

a cover movable between a closed position closing the first opening and an open position opening the first opening;

a drawer comprising a side wall having a second opening; and a separation mechanism configured to move a developing roller between a contact position where the developing roller is in contact with a photosensitive drum and a separated position where the developing roller is away from the photosensitive drum, the separation mechanism comprising:

a cam follower;

a cam configured to move the cam follower between a protruding position in which the cam follower is positioned in the second opening and a standby position in which the cam follower is positioned out of the second opening; and a release member configured to move the cam follower from an operating position to a non-operating position in accordance with movement of the cover from the closed position to the open position, wherein, in a state where the cam follower is at the operating position, the cam follower is moved by the cam between the protruding position and the standby position in accordance with rotation of the cam, and wherein, in a state where the cam follower is at the non-operating position, the cam follower is not moved by the cam and the cam follower is at the standby position independently of the rotation of the cam.

10. The image-forming apparatus according to claim 9, wherein the separation mechanism further comprises a first spring configured to urge the cam follower from the protruding position toward the standby position and from the non-operating position toward the operating position.

11. The image-forming apparatus according to claim 10, further comprising:

a sensor, and a controller, wherein the cam comprises a counterpart detection portion configured to be detected by the sensor, and wherein the controller is configured to control the cam to start rotating in response to the cover moving from the open position to the closed position, and subsequently control the cam to stop rotating after the sensor detects the counterpart detection portion twice and before the sensor detects the counterpart detection portion thrice.

12. The image-forming apparatus according to claim 11, further comprising a motor configured to drive the developing roller, wherein the cam further comprises: a first cam configured to move the cam follower; and a second cam rotatable together with the first cam, and wherein the separation mechanism further comprises:

a clutch configured to switch a power transmission status between an engaging state in which the clutch engages transmission of driving force from the motor to the developing roller and a disengaging state in which the clutch disengages the transmission of the driving force from the motor to the developing roller; and a lever movable by being guided by the second cam, the lever being configured to switch the power transmission status of the clutch between the engaging state and the disengaging state.

13. The image-forming apparatus according to claim 12, wherein in a case where the motor rotates in a normal rotating direction to allow the first cam to guide the cam follower in a state where the cover is at the closed position, the release member is in contact with the cam follower to prevent the cam follower from moving from the operating position to the non-operating position.

14. The image-forming apparatus according to claim 13, further comprising a stopper linearly movable in accordance with linear movement of the release member and movable relative to the release member between a first position and a second position, wherein in a case where the cover moves from the open position to the closed position while the cam follower is at the operating position, the stopper moves in accordance with the movement of the release member to position the cam follower between the release member and the stopper positioned at the first position, and comes into contact with the cam follower to prevent the cam follower from moving to the non-operating position in case of rotation of the motor in a reverse rotating direction opposite to the normal rotating direction, and wherein in a case where the cover moves from the open position to the closed position while the cam follower is at the non-operating position, the cam follower moves toward the operating position by urging force of the first spring, and the cam follower presses the stopper to move to the second position to allow the cam follower to further move to the operating position by the urging force of the first spring.

15. The image-forming apparatus according to claim 12, wherein the clutch comprises a planetary gear mechanism, and wherein the lever is movable between a transmission position at which the lever is engaged with one component of the planetary gear mechanism to place the clutch into the engaging state and a non-transmission position at which the lever is disengaged from the one component of the planetary gear mechanism to place the clutch into the disengaging state.

16. The image-forming apparatus according to claim 15, wherein the lever comprises:

a first lever movable about an axis and contactable with the second cam;

a second lever movable about the axis and engageable with the one component of the planetary gear mechanism, the second lever being provided with a stop portion configured to restrict pivotal movement of the second lever in one direction relative to the first lever; and a second spring configured to urge the first lever in a direction opposite to the one direction, wherein the image-forming apparatus further comprises a third spring configured to urge the second lever in a direction to move toward the one component of the planetary gear mechanism, and wherein when the motor rotates in the reverse rotating direction to cause the second cam to press the first lever in a state where the second lever is engaged with the one component of the planetary gear mechanism, the first lever moves relative to the second lever against urging force of the second spring.

* * * * *